US011202550B2

(12) United States Patent
Dietrich et al.

(10) Patent No.: US 11,202,550 B2
(45) Date of Patent: Dec. 21, 2021

(54) DISHWASHER THERMAL IMAGING SYSTEM

(71) Applicant: Midea Group Co., Ltd., Foshan (CN)

(72) Inventors: Russell Dietrich, Taylorsville, KY (US); Bassam Fawaz, Louisville, KY (US); Robert M. Digman, Goshen, KY (US); Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 192 days.

(21) Appl. No.: 16/689,765

(22) Filed: Nov. 20, 2019

(65) Prior Publication Data

US 2021/0145241 A1 May 20, 2021

(51) Int. Cl.
*A47L 15/00* (2006.01)
*A47L 15/42* (2006.01)

(52) U.S. Cl.
CPC ..... *A47L 15/0028* (2013.01); *A47L 15/4244* (2013.01)

(58) Field of Classification Search
None
See application file for complete search history.

(56) References Cited

U.S. PATENT DOCUMENTS 2,734,520 A 2/1956 Abresch
2,808,063 A 10/1957 Abresch et al.
2,939,465 A 6/1960 Kesling
2,956,572 A 10/1960 Levit et al.
2,973,907 A 3/1961 Abresch et al.
2,980,120 A 4/1961 Jacobs
3,006,557 A 10/1961 Jacobs
3,026,046 A 3/1962 Wickham et al.
3,044,842 A 7/1962 Abresch et al.
3,051,183 A 8/1962 Jacobs
3,082,779 A 3/1963 Jacobs
3,088,474 A 5/1963 Leslie
3,101,730 A 8/1963 Harris et al.
3,115,306 A 12/1963 Graham
3,178,117 A 4/1965 Hanifan
3,192,935 A 7/1965 Hanifan
3,210,010 A 10/1965 Delapena
3,324,867 A 6/1967 Freese
3,348,775 A 10/1967 Flame
3,361,361 A 1/1968 Schutte
3,454,784 A 7/1969 Wantz et al.
(Continued)

FOREIGN PATENT DOCUMENTS

CN 2094961 U 2/1992
CN 1879547 A 12/2006
(Continued)

OTHER PUBLICATIONS

Chitta, Pallavi, (Examiner), U.S Patent and Trademark Office, Office Action issued in U.S. Appl. No. 16/588,135 dated Jul. 20, 2021.

(Continued)

*Primary Examiner* — Rita P Adhlakha
(74) *Attorney, Agent, or Firm* — Middleton Reutlinger

(57) ABSTRACT

A dishwasher and method utilize a thermal imaging system in a dishwasher to configure a wash cycle and/or perform other operations in the dishwasher.

17 Claims, 14 Drawing Sheets

(56) References Cited

U.S. PATENT DOCUMENTS 3,538,927 A 11/1970 Harald
3,586,011 A 6/1971 Mazza
3,590,688 A 7/1971 Brannon
3,596,834 A 8/1971 Cushing
3,719,323 A 3/1973 Raiser
3,888,269 A 6/1975 Bashark
4,175,575 A 11/1979 Cushing
4,226,490 A 10/1980 Jenkins et al.
4,398,562 A 8/1983 Saarem et al.
4,718,440 A 1/1988 Hawker et al.
4,732,323 A 3/1988 Jarvis et al.
5,131,419 A 7/1992 Roberts
5,211,190 A 5/1993 Johnson et al.
5,226,454 A 7/1993 Cabalfin
5,291,626 A 3/1994 Molnar et al.
5,341,827 A 8/1994 Kim
5,477,576 A 12/1995 Berkcan
5,586,567 A 12/1996 Smith et al.
5,697,392 A 12/1997 Johnson et al.
5,725,002 A 3/1998 Payzant
5,800,628 A 9/1998 Erickson et al.
6,053,185 A 3/2000 Cirjak et al.
6,431,188 B1 8/2002 Laszczewski, Jr. et al.
6,675,818 B1 1/2004 Schrott et al.
6,694,990 B2 2/2004 Spanyer et al.
6,869,029 B2 3/2005 Ochoa et al.
7,055,537 B2 6/2006 Elick et al.
7,210,315 B2 5/2007 Castelli et al.
7,293,435 B2 11/2007 Elexpuru et al.
7,445,013 B2 11/2008 VanderRoest et al.
7,464,718 B2 12/2008 McIntyre et al.
7,556,049 B2 7/2009 Oakes et al.
7,578,303 B2 8/2009 Daume et al.
7,587,916 B2 9/2009 Rizzetto
7,594,513 B2 9/2009 VanderRoest et al.
7,607,325 B2 10/2009 Elexpuru et al.
7,650,765 B2 1/2010 Rizzetto
7,842,137 B2 11/2010 Classen et al.
7,914,625 B2 3/2011 Bertsch et al.
7,935,194 B2 5/2011 Rolek
7,959,744 B2 6/2011 Sundaram et al.
8,136,537 B2 3/2012 Cerrano et al.
8,191,560 B2 6/2012 Mallory et al.
8,229,161 B2 7/2012 Hudnut et al.
8,443,765 B2 5/2013 Hollis
8,509,473 B2 8/2013 Ashrafzadeh et al.
8,696,827 B2 4/2014 Buddharaju et al.
8,858,729 B2 10/2014 Büsing et al.
8,900,375 B2 12/2014 Beaudet et al.
8,915,257 B2 12/2014 Buesing
8,932,411 B2 1/2015 Pyo et al.
8,978,674 B2 3/2015 Wagner
8,985,128 B2 3/2015 Ashrafzadeh et al.
9,121,217 B1 9/2015 Hoffberg
9,170,584 B2 10/2015 Lum et al.
9,204,780 B2 12/2015 Francisco et al.
9,220,393 B2 12/2015 Becker et al.
9,241,604 B2 1/2016 Dries
9,259,137 B2 2/2016 Boyer et al.
9,265,400 B2 2/2016 Bigott
9,271,626 B2 * 3/2016 Dalton ..... A47L 15/0002
9,307,888 B2 4/2016 Baldwin et al.
9,326,657 B2 5/2016 Thiyagarajan
9,468,956 B2 10/2016 Simundic et al.
9,480,389 B2 11/2016 Haft et al.
9,492,055 B2 11/2016 Feddema
9,532,700 B2 1/2017 Welch
9,635,994 B2 5/2017 Boyer et al.
9,649,008 B2 5/2017 Kim et al.
9,655,496 B2 5/2017 Baldwin et al.
9,763,552 B2 9/2017 Chapman et al.
9,915,356 B2 3/2018 Chang et al.
9,958,073 B2 5/2018 Yang
9,993,134 B2 6/2018 Dreossi et al.
10,080,477 B2 9/2018 Fauth et al.
10,105,031 B2 10/2018 Dreossi et al.
10,169,881 B2 1/2019 Karasawa
10,307,035 B2 6/2019 Chen et al.
2002/0062849 A1 5/2002 Ekelhoff
2002/0185162 A1 12/2002 Rosenbauer et al.
2003/0034052 A1 2/2003 Kiesler et al.
2004/0079400 A1 4/2004 Young
2005/0011544 A1 1/2005 Rosenbauer et al.
2005/0139240 A1 6/2005 Bong et al.
2005/0155393 A1 7/2005 Wright et al.
2005/0231716 A1 10/2005 Ryu et al.
2005/0241680 A1 11/2005 Noh
2005/0241681 A1 11/2005 Hwang
2006/0278258 A1 12/2006 Kara et al.
2007/0046942 A1 3/2007 Ng et al.
2007/0118638 A1 5/2007 Ban et al.
2007/0181162 A1 8/2007 Classen et al.
2007/0272272 A1 11/2007 Choi et al.
2008/0128001 A1 6/2008 Kennichi et al.
2008/0163904 A1 7/2008 Hwang
2008/0271765 A1 11/2008 Burrows
2008/0276975 A1 11/2008 Disch
2009/0071508 A1 3/2009 Sundaram et al.
2009/0090400 A1 4/2009 Burrows et al.
2009/0145468 A1 6/2009 Chericoni
2009/0231581 A1 9/2009 Han et al.
2010/0043826 A1 2/2010 Bertsch et al.
2010/0175718 A1 7/2010 Kedjierski et al.
2010/0294311 A1 11/2010 Classen et al.
2011/0017235 A1 1/2011 Berner et al.
2011/0186085 A1 8/2011 Chen et al.
2012/0060875 A1 3/2012 Fauth et al.
2012/0138092 A1 6/2012 Ashrafzadeh et al.
2012/0175431 A1 7/2012 Althammer et al.
2012/0291827 A1 11/2012 Buddharaju et al.
2013/0000762 A1 1/2013 Buddharaju et al.
2013/0171023 A1 7/2013 Ben-Shmuel et al.
2013/0319483 A1 12/2013 Welch
2014/0059880 A1 3/2014 Bertsch et al.
2014/0069462 A1 3/2014 Becker et al.
2014/0069470 A1 3/2014 Baldwin et al.
2014/0111071 A1 4/2014 Bhajak et al.
2014/0190519 A1 7/2014 Simundic et al.
2014/0373876 A1 12/2014 Feddema
2015/0002658 A1 1/2015 Jaw et al.
2015/0007861 A1 1/2015 Azmi et al.
2015/0201823 A1 7/2015 Poojary et al.
2015/0266065 A1 9/2015 Savoia
2016/0096020 A1 4/2016 Smith
2016/0198928 A1 7/2016 Xu et al.
2016/0296097 A1 10/2016 Dreossi et al.
2016/0324396 A1 11/2016 Hong et al.
2016/0367107 A1 12/2016 Ellingson et al.
2017/0135550 A1 5/2017 Shin et al.
2017/0172371 A1 6/2017 Engesser et al.
2017/0181599 A1 6/2017 Choi et al.
2017/0202426 A1 7/2017 Bosen et al.
2017/0224190 A1 8/2017 Sakthivel et al.
2017/0231464 A1 8/2017 Kong et al.
2017/0273535 A1 9/2017 Roderick et al.
2017/0332877 A1 11/2017 Pers et al.
2017/0354308 A1 12/2017 Choi et al.
2018/0036889 A1 2/2018 Birkmeyer et al.
2018/0084967 A1 3/2018 Ross et al.
2018/0107879 A1 4/2018 Laput et al.
2018/0110397 A1 4/2018 Kim et al.
2018/0132692 A1 5/2018 Dries
2018/0133583 A1 5/2018 Tran et al.
2018/0168425 A1 6/2018 Wilson et al.
2018/0192851 A1 7/2018 Gursoy et al.
2018/0304293 A1 10/2018 Orla-jensen et al.
2019/0099054 A1 4/2019 Digman et al.
2019/0191959 A1 6/2019 Brightbill et al.
2019/0290094 A1 9/2019 Balinski et al.
2019/0290095 A1 9/2019 Wahlberg et al.
2019/0380559 A1 12/2019 Lee et al.
2020/0000310 A1 1/2020 Chu
2020/0138261 A1 5/2020 Terrádez et al.
2020/0138263 A1 5/2020 Terrádez et al.

(56) References Cited

U.S. PATENT DOCUMENTS

| | | | |
|---|---|---|---|
| 2020/0163526 | A1 | 5/2020 | Yoon et al. |
| 2021/0068612 | A1 | 3/2021 | Park |
| 2021/0093149 | A1 | 4/2021 | Fawaz et al. |
| 2021/0093151 | A1 | 4/2021 | Boyer et al. |
| 2021/0093152 | A1 | 4/2021 | Boyer et al. |
| 2021/0093153 | A1 | 4/2021 | Boyer et al. |
| 2021/0093154 | A1 | 4/2021 | Boyer et al. |
| 2021/0093155 | A1 | 4/2021 | Boyer |
| 2021/0145240 | A1 | 5/2021 | Fawaz |

FOREIGN PATENT DOCUMENTS

| | | | |
|---|---|---|---|
| CN | 101134198 | A | 3/2008 |
| CN | 201067392 | Y | 6/2008 |
| CN | 101795613 | A | 8/2010 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 104523208 | A | 4/2015 |
| CN | 104757921 | A | 7/2015 |
| CN | 204671085 | U | 9/2015 |
| CN | 105147218 | A | 12/2015 |
| CN | 105231971 | A | 1/2016 |
| CN | 205094364 | U | 3/2016 |
| CN | 106419794 | A | 2/2017 |
| CN | 107485356 | A | 12/2017 |
| DE | 3537184 | A1 | 4/1987 |
| DE | 10048081 | A1 | 4/2002 |
| DE | 10121083 | A1 | 10/2002 |
| DE | 10300501 | A1 | 7/2004 |
| DE | 202004013786 | U1 | 11/2004 |
| DE | 102008011743 | A1 | 9/2009 |
| DE | 202014010365 | U1 | 5/2015 |
| DE | 102014215660 | A1 | 1/2016 |
| DE | 102015103040 | A1 | 9/2016 |
| DE | 102016202267 | A1 | 8/2017 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 0943287 | A1 | 9/1999 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1635167 | A1 | 3/2006 |
| EP | 1758494 | A1 | 3/2007 |
| EP | 2636786 | A1 | 9/2013 |
| EP | 2059160 | B1 | 3/2015 |
| EP | 3498145 | A1 | 6/2016 |
| EP | 3427630 | A1 | 1/2019 |
| EP | 3476269 | A1 | 5/2019 |
| FR | 1473796 | A | 3/1967 |
| GB | 572623 | A | 10/1945 |
| GB | 2244209 | A | 11/1991 |
| JP | 2003235781 | A | 8/2003 |
| JP | 2003339607 | A | 12/2003 |
| JP | 2009273490 | A | 11/2009 |
| JP | 2014121353 | A | 7/2014 |
| JP | 2017144240 | A | 8/2017 |
| KR | 100786069 | B1 | 12/2007 |
| KR | 101173691 | B1 | 8/2012 |
| KR | 200464747 | Y1 | 1/2013 |
| KR | 101387609 | B1 | 4/2014 |
| WO | WO2009008827 | A1 | 1/2009 |
| WO | WO2011080232 | A1 | 7/2011 |
| WO | WO2012173479 | A1 | 12/2012 |
| WO | WO2016008699 | A1 | 1/2016 |
| WO | WO2016096020 | A1 | 6/2016 |
| WO | WO2017032629 | A1 | 3/2017 |
| WO | WO2018053635 | A1 | 3/2018 |
| WO | WO2018108285 | A1 | 6/2018 |
| WO | WO2018114363 | A1 | 6/2018 |
| WO | WO2018228679 | A1 | 12/2018 |

OTHER PUBLICATIONS

Golightly, Eric Wayne, (Examiner), U.S. Patent and Trademark Office, Final Office Action issued in U.S. Appl. No. 16/587,826 dated Sep. 21, 2021.

Le, Peter D., (Examiner), U.S. Patent and Trademark Office, Final Office Action issued in U.S. Appl. No. 16/588,034 dated Dec. 23, 2020.

Chaudhri, Omair, (Examiner), U.S. Patent and Trademark Office, Notice of Allowance issued in U.S. Appl. No. 16/587,820 dated Sep. 3, 2021.

Sokol "This is What Happens When You Put a Camera in A Dishwasher" https://www.vice.com/en_us/article/wyeyx/this-is-what-the-inside-of-a-dish-washer-cycle-looks-like, Jun. 2014.

"Technology" sensorsllc.com/technology.html, Sensor Systems, 2017.

"Magnet Sensors in Dish washer Spray Arm Jam Detection" https://www.reed-sensor.com/applications/white-goods/spray-arm-jam-detection/ Accessed Jul. 2, 2019.

"Intelligent Dishwasher Outsmarks Dirt" https://www.designnews.com/electronics-test/intelligent-dishwasher-soutsmarts-dirt/151626670139713. Design News, Apr. 1995.

"LG Electronics, LG Connected Appliances Lead Home Kitchens Into The Future: Network of Appliances Offers Seamless Connectivity with LG InstaView ThinQ Refrigerator, EasyClean Oven Range and QuadWash Dishwasher", https://www.prnewswire.com/news-releases/lg-connected-appliances-lead-home-kitchens-into-the-future-300578674, Jan. 7, 2018.

Sears "Kenmore Elite 2013 Stainless Steel Tall Tub Dishwasher Service Manual", Dec. 5, 2018.

DE10121083A1 machine translation (Year: 2002).

Everyspec, Federal Specification: Dishwashing Machines, Single Tank and Double Tank, Commercial, www.everyspec.com, Oct. 17, 1983.

Electrolux Home Products, Inc. "Dishwasher Use & Care Guide 1500 Series with Fully Electronic Control" 2003.

Transmittal of Related Applications.

Golightly, Eric Wayne, (Examiner), U.S Patent and Trademark Office, Non-Final Office Action issued in U.S. Appl. No. 16/587,826 dated Apr. 14, 2021.

Le, Peter D., (Examiner), U.S. Patent and Trademark Office, Notice of Allowance issued in U.S. Appl. No. 16/588,034 dated Apr. 19, 2021.

Chaudhri, Omair, (Examiner), U.S. Patent and Trademark Office, Office Action issued in U.S. Appl. No. 16/587,820 dated Apr. 19, 2021.

Le, Peter D., (Examiner), U.S. Patent and Trademark Office, Office Action issued in U.S. Appl. No. 16/588,034 dated Sep. 14, 2020.

Bell, Spencer E., (Examiner), U.S. Patent and Trademark Office, Notice of Allowance issued in U.S. Appl. No. 16/689,528 dated Oct. 7, 2021.

Chaudhri, Omair, (Examiner), U.S. Patent and Trademark Office, Corrected Notice of Allowance issued in U.S. Appl. No. 16/587,820 dated Oct. 8, 2021.

Cormier, David G., (Examiner), U.S. Patent and Trademark Office, Office Action issued in U.S. Appl. No. 16/588,310 dated Oct. 8, 2021.

Bell, Spencer E., (Examiner), U.S. Patent and Trademark Office, Office Action issued in U.S. Appl. No. 16/689,528 dated Jun. 9, 2021.

* cited by examiner

DISHWASHER THERMAL IMAGING SYSTEM

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming of that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

Various efforts have been made to attempt to customize wash cycles to improve efficiency as well as wash performance, e.g., using cameras and other types of image sensors to sense the contents of a dishwasher, as well as utilizing spray arms that provide more focused washing in particular areas of a dishwasher. Nonetheless, a significant need still exists in the art for greater efficiency and efficacy in dishwasher performance.

SUMMARY

The herein-described embodiments address these and other problems associated with the art by utilizing a thermal imaging system within a dishwasher to configure a wash cycle in various manners.

Therefore, consistent with one aspect of the invention, a dishwasher may include a wash tub, a thermal imaging device configured to capture thermal images in the wash tub, and a controller coupled to the thermal imaging device and configured to control a wash cycle that washes a plurality of utensils disposed in the wash tub, the controller further configured to control the thermal imaging device to capture a thermal image of a utensil among the plurality of utensils and to configure the wash cycle based upon water drops disposed on the utensil and detected in the thermal image.

In some embodiments, the controller is configured to detect the water drops in the thermal image by performing image analysis on the thermal image to identify the water drops in the thermal image. Also, in some embodiments, the controller is configured to detect the water drops in the thermal image by communicating the thermal image to a remote device that identifies the water drops in the thermal image, and receiving a response associated therewith from the remote device. Further, in some embodiments, detection of the water drops in the thermal image is based upon a temperature variance between the water drops and a surface of the utensil upon which the water drops are disposed that is reflected in one or more regions of the thermal image corresponding to the water drops.

In some embodiments, the controller is configured to configure the wash cycle based upon the water drops by controlling a number and/or duration of a rinse operation, a wash operation, a soak operation or a drying operation. In addition, in some embodiments, the controller is configured to configure the wash cycle based upon the water drops by controlling a fluid temperature, a fluid volume, a fan speed or a heating element temperature.

Some embodiments may also include a controllably-movable sprayer in fluid communication with a fluid supply, and the controller is coupled to the controllably-movable sprayer and is configured to configure the wash cycle based upon the water drops by controlling the controllably-movable sprayer to spray fluid onto a target based upon a detected location of one or more of the water drops. In some embodiments, the fluid supply is an air supply, and the controller is configured to control the controllably-movable sprayer to spray pressurized air onto the target.

In addition, in some embodiments, the controller is configured to configure the wash cycle based upon the water drops by controlling a duration of a condensation drying operation of the wash cycle performed subsequent to a hot water rinse of the plurality of utensils. Moreover, in some embodiments, the controller is configured to control the thermal imaging device to capture thermal images as the plurality of utensils cool during the condensation drying operation. In some embodiments, the controller is configured to detect water drops on a utensil among the plurality of utensils after a temperature variance has been established between the water drops and a surface of the utensil.

Moreover, in some embodiments, the controller is further configured to detect an absence of water drops on the utensil after detecting the water drops, and to control a duration of the condensation drying operation based upon the detection of the absence of water drops. In some embodiments, the controller is further configured to store a thermal image depicting water drops as baseline thermal image, and to detect the absence of water drops by comparing the baseline thermal image with a thermal image captured subsequent to the baseline thermal image. In addition, in some embodiments, the controller is further configured to detect a decrease in size and/or number of water drops on the utensil after detecting the water drops, and to control a duration of the condensation drying operation based thereon.

In some embodiments, the controller is configured to control the thermal imaging device to begin capturing thermal images as the plurality of utensils cool during the condensation drying operation only after a predetermined period of time sufficient to establish a temperature variance between the water drops and surfaces of the plurality of utensils has expired. Moreover, in some embodiments, the controller is configured to detect water drops on a utensil among the plurality of utensils further by performing image analysis to identify a surface of the utensil such that water drops disposed on surfaces of non-utensil objects depicted in the thermal image are ignored. Also, in some embodiments, the controller is configured to detect water drops on a utensil among the plurality of utensils further by performing image analysis on the thermal image and on one or more images captured by a visible spectrum imaging device disposed in the wash tub.

Consistent with another aspect of the invention, a method of operating a dishwasher may include controlling a wash cycle that washes a plurality of utensils disposed in a wash tub, capturing a thermal image of a utensil in the wash tub, and configuring the wash cycle based upon water drops disposed on the utensil and detected in the thermal image.

Consistent with another aspect of the invention, a dishwasher may include a wash tub, a thermal imaging device configured to capture thermal images in the wash tub, and a controller coupled to the thermal imaging device and configured to control a wash cycle that washes a plurality of utensils disposed in the wash tub, the controller further configured to control the thermal imaging device to capture a thermal image of a utensil among the plurality of utensils and to configure an operation of the wash cycle based upon a temperature of the utensil as determined from the thermal image.

Some embodiments may also include a controllably-movable sprayer disposed in the wash tub, and the controller is configured to configure the operation of the wash cycle based upon the temperature of the utensil by directing the controllably-movable sprayer to target a predetermined area of the wash tub based upon the temperature of the utensil. In addition, in some embodiments, the utensil is disposed in the predetermined area of the wash tub, the operation is a wash or rinse operation, and the controller is configured to direct the controllably-movable sprayer to target the predetermined area of the wash tub based upon the temperature of the utensil being below that of another utensil disposed in a different area of the wash tub. Also, in some embodiments, the utensil is disposed in the predetermined area of the wash tub, the operation is a drying operation, and the controller is configured to direct the controllably-movable sprayer to target the predetermined area of the wash tub based upon the temperature of the utensil being above that of another utensil disposed in a different area of the wash tub.

Consistent with another aspect of the invention, a method of operating a dishwasher may include controlling a wash cycle that washes a plurality of utensils disposed in a wash tub, capturing a thermal image of a utensil in the wash tub, and configuring an operation of the wash cycle based upon a temperature of the utensil as determined from the thermal image.

Consistent with another aspect of the invention, a dishwasher may include a wash tub including a sump, a heating element disposed in the sump, a thermal imaging device configured to capture thermal images of the sump, and a controller coupled to the heating element and the thermal imaging device and configured to control the thermal imaging device to capture a thermal image of the sump and regulate the heating element based upon a temperature of fluid disposed in the sump and determined from the thermal image.

Consistent with another aspect of the invention, a method of operating a dishwasher may include controlling a wash cycle that washes a plurality of utensils disposed in a wash tub, capturing a thermal image of a sump in the wash tub, and regulating a heating element disposed in the sump based upon a temperature of fluid disposed in the sump and determined from the thermal image.

Consistent with another aspect of the invention, a dishwasher may include a wash tub, a dishwasher component disposed in the wash tub, a thermal imaging device configured to capture thermal images of the component, and a controller coupled to the thermal imaging device and configured to control the thermal imaging device to capture a thermal image of the dishwasher component and monitor a state of the dishwasher component based upon the captured thermal image.

Moreover, in some embodiments, the dishwasher component is a heating element, and the controller is configured to deactivate the heating element, terminate a wash cycle, signal an error or notify a user in response to one or more temperatures of the heating element determined from the captured thermal image when monitoring the state of the dishwasher component.

Consistent with another aspect of the invention, a method of operating a dishwasher may include controlling a wash cycle that washes a plurality of utensils disposed in a wash tub, capturing a thermal image of a dishwasher component in the wash tub, and monitoring a state of the dishwasher component based upon the captured thermal image.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
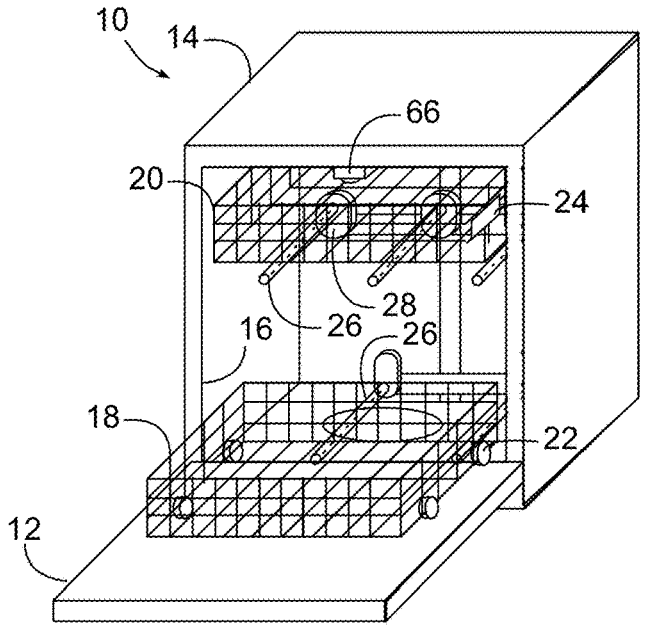
FIG. 1 is a perspective view of a dishwasher consistent with some embodiments of the invention.

In various embodiments discussed hereinafter, an imaging system may be used within a dishwasher to perform various operations within the dishwasher. An imaging system, in this regard, may be considered to include one or more cameras or other imaging devices capable of capturing images within a dishwasher. The images may be captured in the visible spectrum in some embodiments, while in other embodiments other spectrums may be captured, e.g., the infrared spectrum. Imaging devices may be positioned in fixed locations within a dishwasher in some embodiments, and in other embodiments may be positioned on movable and/or controllable components, as will become more apparent below. In addition, captured images may be analyzed locally within a dishwasher in some embodiments, while in other embodiments captured images may be analyzed remotely, e.g., using a cloud-based service. Furthermore, imaging devices may generate two dimensional images in some embodiments, while in other embodiments captured images may be three dimensional in nature, e.g., to enable surface models to be generated for structures within a dishwasher, including both components of the dishwasher and articles placed in the dishwasher to be washed. Images may also be combined in some embodiments, and in some embodiments multiple images may be combined into videos clips prior to analysis.

In some embodiments consistent with the invention, and as will become more apparent below, an imaging system may be utilized in connection with one or more controllable sprayers. A controllable sprayer, in this regard, may refer to a component capable of selectively generating a spray of fluid towards any of a plurality of particular spots, locations, or regions of a dishwasher, such that through control of the sprayer, fluid may be selectively sprayed into different spots, locations or regions as desired. When paired with an imaging system consistent with the invention, therefore, a controller of a dishwasher may be capable of controlling one or more controllable sprayers to direct fluid into specific spots, locations or regions based upon images captured by an imaging system.

In some instances, a controllable sprayer may be implemented using multiple nozzles directed at different spots, locations or regions and selectively switchable between active and inactive states. In other embodiments, however, a controllable sprayer may be a controllably-movable sprayer that is capable of being moved, e.g., through rotation, translation or a combination thereof, to direct a spray of fluid to different spots, locations or regions. Moreover, while some controllably-movable sprayers may include designs such as gantry-mounted wash arms or other sprayers, controllably-rotatable wash arms, motorized sprayers, and the like, in some embodiments, a controllably-movable sprayer may be configured as a tubular spray element that is rotatable about a longitudinal axis and discretely directed through each of a plurality of rotational positions about the longitudinal axis by a tubular spray element drive to spray a fluid such as a wash liquid and/or pressurized air in a controlled direction generally transverse from the longitudinal axis about which the tubular spray element rotates.

A tubular spray element, in this regard, may be considered to include an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates, and furthermore, a tubular spray element drive is coupled to the tubular spray element to discretely direct the tubular spray element to multiple rotational positions about the longitudinal axis. In addition, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number of embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, a tubular spray element may be mounted on a movable portion of the dishwasher, e.g., a rack, and may be operably coupled to such a drive through a docking arrangement that both rotates the tubular spray element and supplies fluid to the tubular spray element when the tubular spray element is docked in the docking arrangement. In other embodiments, however, a tubular spray element may be mounted to a fixed portion of a dishwasher, e.g., a wash tub wall, whereby no docking arrangement is used. Further details regarding tubular spray elements may be found, for example, in U.S. Pub. No. 2019/0099054 filed by Digman et al., which is incorporated by reference herein.

It will be appreciated, however, that an imaging system consistent with the invention may, in some instances, be used in a dishwasher having other types of spray elements, e.g., rotatable spray arms, fixed sprayers, etc., as well as in a dishwasher having spray elements that are not discretely directable or otherwise controllable or controllably-movable. Therefore, the invention is not limited in all instances to use in connection with the various types of sprayers described herein.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
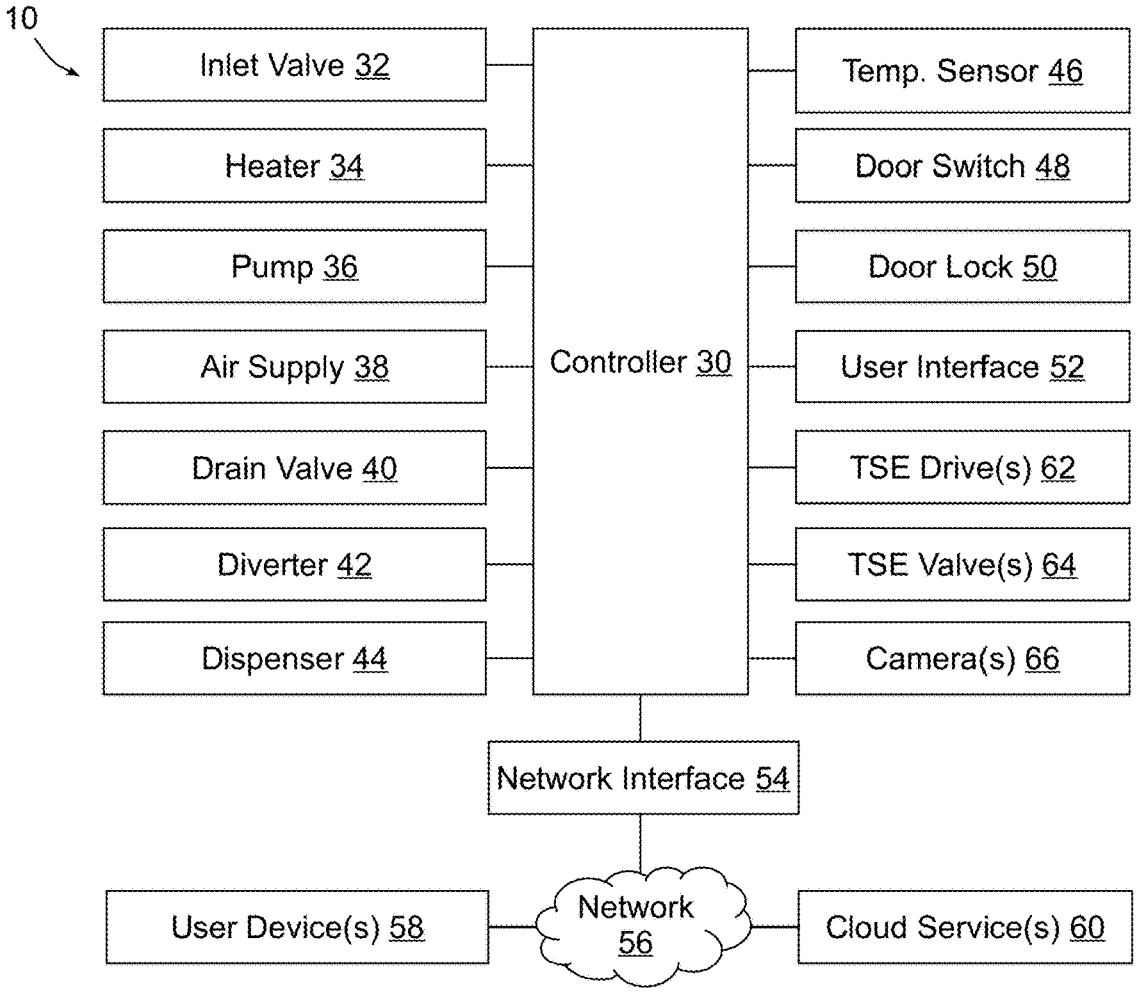
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances, and thus a fluid supply in some embodiments may supply various liquid wash fluids to various sprayers in the dishwasher. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks 56 such as Ethernet, Bluetooth, NFC, cellular and other suitable networks. External devices may include, for example, one or more user devices 58, e.g., mobile devices, desktop computers, etc., and one or more cloud services 60, e.g., as may be provided by a manufacturer of dishwasher 10. Other types of devices, e.g., devices associated with maintenance or repair personnel, may also interface with dishwasher 10 in some embodiments.

Additional components may also be interfaced with controller 30, as will be appreciated by those of ordinary skill having the benefit of the instant disclosure. For example, one or more tubular spray element (TSE) drives 62 and/or one or more tubular spray element (TSE) valves 64 may be provided in some embodiments to discretely control one or more tubular spray elements disposed in dishwasher 10, as will be discussed in greater detail below. Further, an imaging system including one or more cameras 66 (see also FIG. 1 for an example physical location of a camera 66 in dishwasher 10) may also be provided in some embodiments to provide visual information suitable for implementing some of the functionality described herein.

It will be appreciated that each tubular spray element drive 62 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 64 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a user device 58, a cloud service 60, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Furthermore, additional details regarding the concepts disclosed herein may also be found in the following co-pending applications, all of which were filed on Sep. 30, 2019, and all of which are incorporated by reference herein: U.S. application Ser. No. 16/588,969, entitled "DISHWASHER WITH IMAGE-BASED OBJECT SENSING," U.S. application Ser. No. 16/588,034, entitled "DISHWASHER WITH IMAGE-BASED FLUID CONDITION SENSING," U.S. application Ser. No. 16/588,135, entitled "DISHWASHER WITH CAM-BASED POSITION SENSOR," U.S. application Ser. No. 16/587,820, entitled "DISHWASHER WITH IMAGE-BASED POSITION SENSOR," U.S. application Ser. No. 16/588,310, entitled "DISHWASHER WITH IMAGE-BASED DETERGENT SENSING," and U.S. application Ser. No. 16/587,826, entitled "DISHWASHER WITH IMAGE-BASED DIAGNOSTICS."

Tubular Spray Elements

Figure 3:
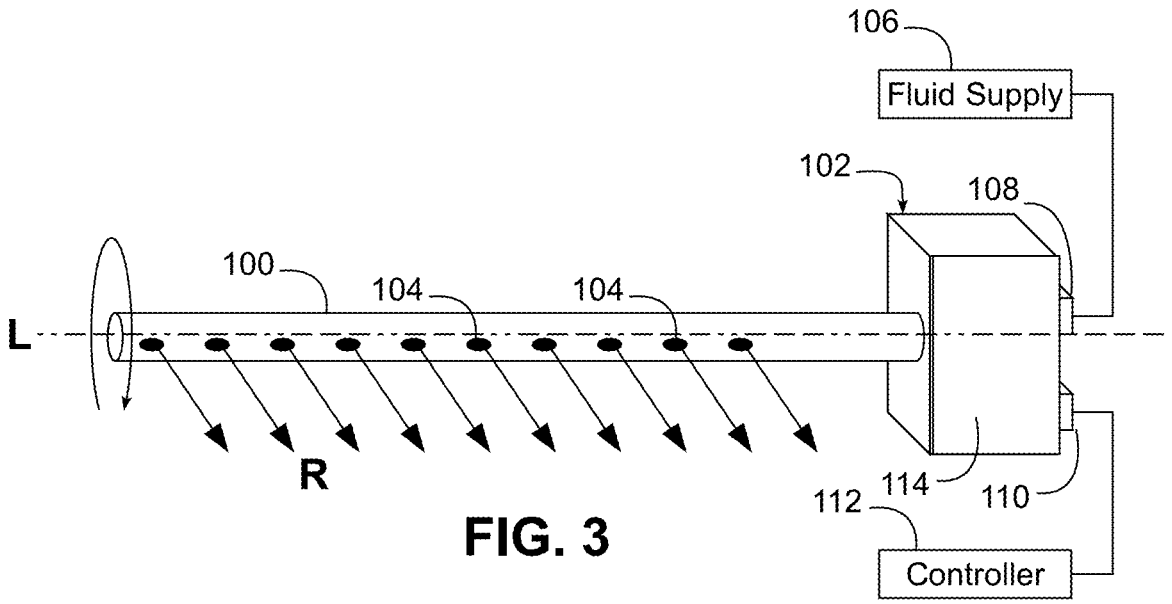
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element may be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
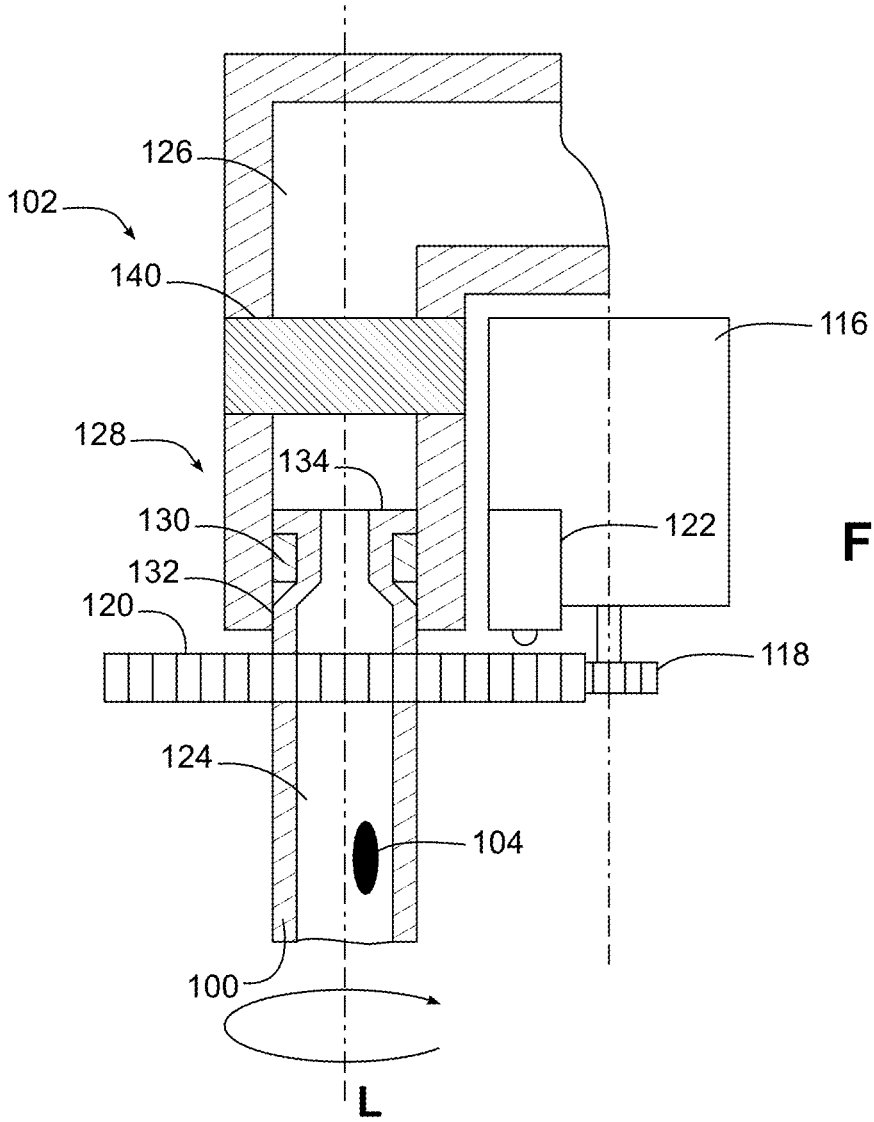
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pulley drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element, or using one or more microswitches and a cam configured to engage the microswitches at predetermined rotational positions. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

In addition, it also may be desirable in some embodiments to incorporate a valve 140 into a tubular spray element drive 102 to regulate the fluid flow to tubular spray element 100. Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 100 and tubular spray element drive 102. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 100, e.g., using an iris valve, butterfly valve, gate valve, plunger valve, piston valve, valve with a rotatable disk, ball valve, etc., and actuated by a solenoid, motor or other separate mechanism from the mechanism that rotates tubular spray element 100. In other embodiments, however, valve 140 may be actuated through rotation of tubular spray element 100. In some embodiments, for example, rotation of tubular spray element 100 to a predetermined rotational position may be close valve 140, e.g., where valve 140 includes an arcuate channel that permits fluid flow over only a range of rotational positions. As another example, a valve may be actuated through over-rotation of a tubular spray element or through counter rotation of a tubular spray element.

Tubular spray elements may be mounted within a wash tub in various manners in different embodiments, e.g., mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive. Moreover, rather than being mounted in a cantilevered fashion as is the case with tubular spray element 100 of FIG. 3, a tubular spray element may also be mounted on a wall of a wash tub and supported at both ends. In still other embodiments, a tubular spray element may be rack-mounted, with either the associated tubular spray element drive also rack-mounted or alternatively mounted on a wall of the wash tub. It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Additional features that may be utilized in a dishwasher including tubular spray elements are described, for example, in U.S. application Ser. Nos. 16/132,091, 16/132,106, 16/132,114, 16/132,125 filed on Sep. 14, 2018 and U.S. application Ser. No. 16/298,007 filed on Mar. 11, 2019, all of which are all assigned to the same assignee as the present application, and all of which are hereby incorporated by reference herein.

Imaging System

Figure 5:
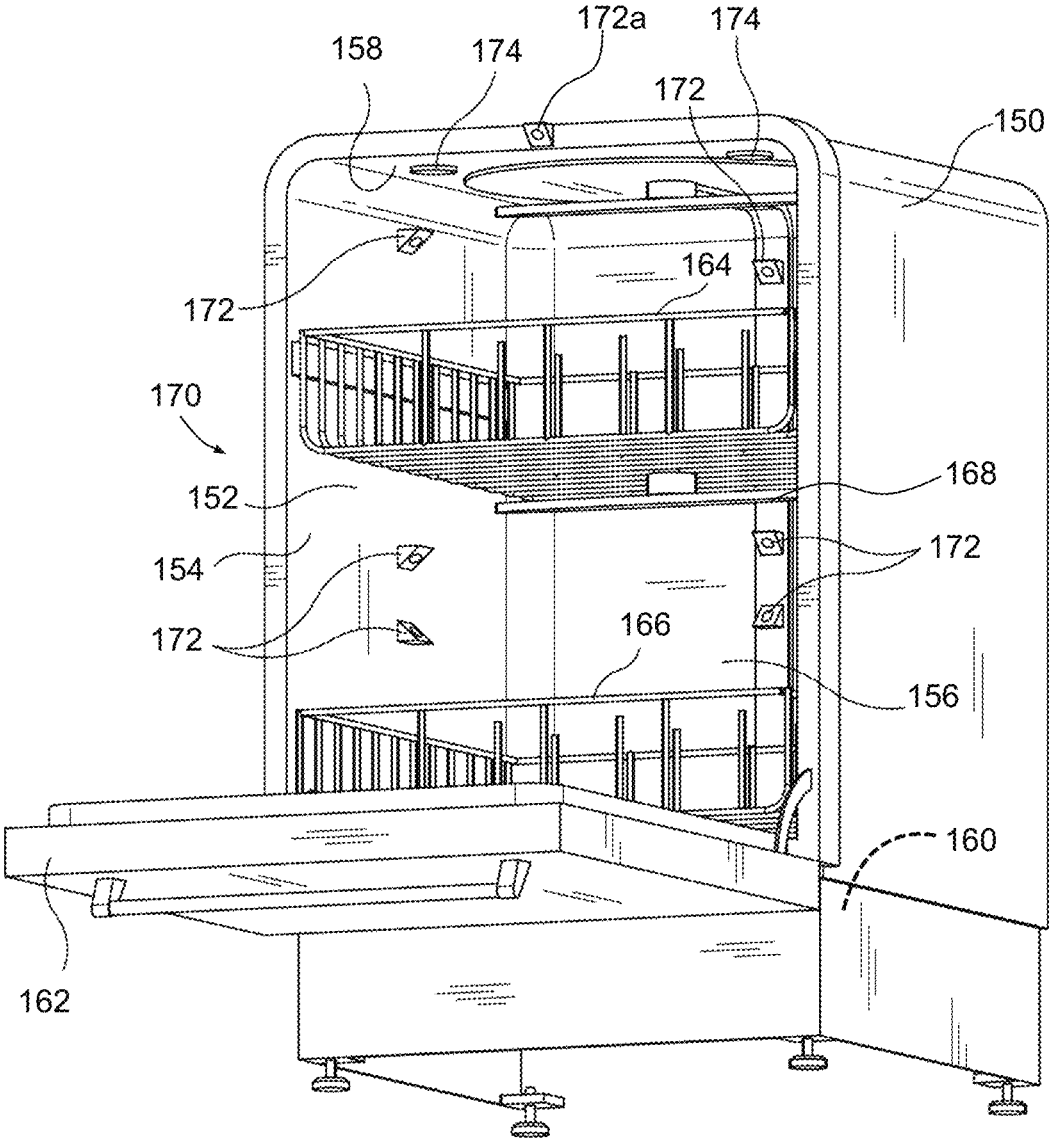
FIG. 5 is a perspective view of another dishwasher consistent with some embodiments of the invention, and incorporating an imaging system having multiple fixed cameras.

Now turning to FIG. 5, as noted above, a dishwasher consistent with the invention may also include an imaging system including one or more cameras or other imaging devices. FIG. 5, for example, illustrates an example dishwasher 150 including a wash tub 152 having side walls 154, a rear wall 156, a top wall 158 and a sump 160, a hinged door 162 providing access to the wash tub, and one or more racks, e.g., upper and lower racks 164, 166. While in some embodiments, tubular spray elements may be used to spray wash fluid throughout wash tub 152, in the embodiment illustrated in FIG. 5, one or more rotatable spray arms, e.g., spray arm 168 mounted to upper rack 164, may be used in lieu of or in addition to tubular spray elements.

An imaging system 170, including, for example, one or more cameras 172, may be used to collect image data within wash tub 152 for a variety of purposes. As noted above, cameras 172 may operate in the visible spectrum (e.g., RGB cameras) in some embodiments, or may operate in other spectra, e.g., the infrared spectrum (e.g., IR cameras), the ultraviolet spectrum, etc. Moreover, cameras 172 may collect two dimensional and/or three dimensional image data in different embodiments, may use range or distance sensing (e.g., using LIDAR), and may generate static images and/or video clips in various embodiments. Cameras may be disposed at various locations within a wash tub, including, for example, on any of walls 154, 156, 158, in corners between walls, on components mounted to walls (e.g., fluid supply conduits), in sump 160, on door 162, on any of racks 164, 166, or even on a spray arm 168, tubular spray element, or other movable component within a dishwasher. Moreover, different types of imaging devices may be used at different locations, or multiple imaging device of different types may be used at the same location (e.g., RGB in one location and IR in another, or RGB and IR in the same location). In addition, an imaging system 170 may also in some embodiments include one or more lights or other illumination devices 174 suitable for illuminating the wash tub to facilitate image collection. Illumination devices 174 may illuminate light in various spectra, including white light, infrared light, ultraviolet light, or even colored light in a particular segment of the visible spectra, e.g. a green, blue, or red light, or patterns of light (e.g., lines, grids, moving shapes, etc.), as may be desirable for particular applications, such as 3D applications. In addition, as illustrated by camera 172*a*, a camera may also capture image data outside of a wash tub, e.g., to capture images of a rack that has been extended to a loading position.

As noted above, and as is illustrated by cameras 172 and 172*a*, cameras may be fixed in some embodiments, and it may be desirable to utilize multiple cameras to ensure suitable coverage of all areas of a washtub for which it is desirable to collect image data. In other embodiments only a single camera may be used, and in addition, in some embodiments one or multiple cameras may be disposed on a movable component of a dishwasher to vary the viewpoint of the camera to capture different areas or perspectives within a dishwasher.

Figure 6:
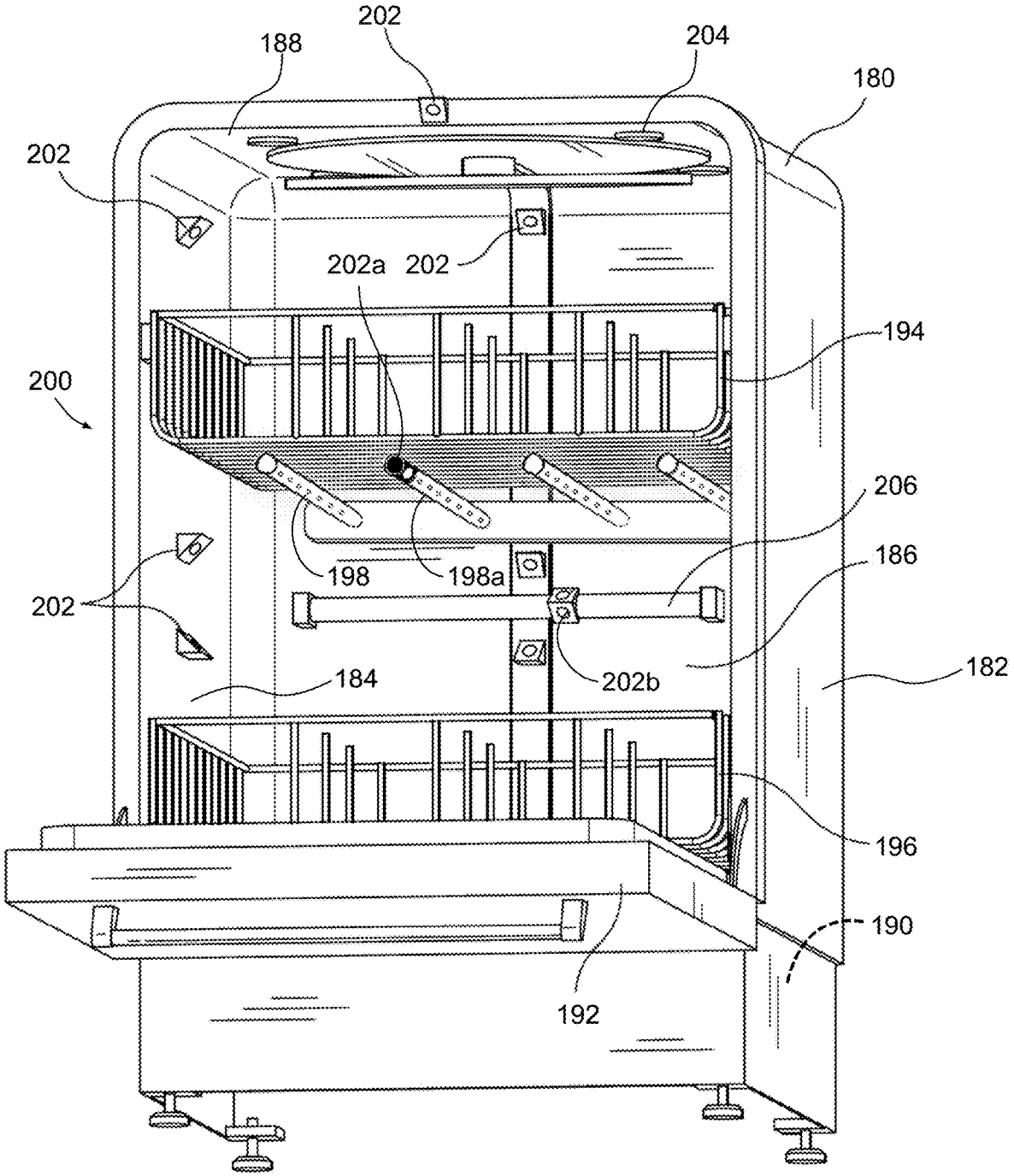
FIG. 6 is a perspective view of yet another dishwasher consistent with some embodiments of the invention, and incorporating an imaging system having multiple fixed and movable cameras.

FIG. 6, for example, illustrates an example dishwasher 180 including a wash tub 182 having side walls 184, a rear wall 186, a top wall 188 and a sump 190, a hinged door 192 providing access to the wash tub, and one or more racks, e.g., upper and lower racks 194, 196. In addition, in this embodiment, a plurality of tubular spray elements 198 are used to spray wash fluid throughout wash tub 182. An imaging system 200, including, for example, one or more cameras 202, may be used to collect image data within wash tub 182 for a variety of purposes, and one or more illumination devices 204 may also be disposed in the dishwasher for illumination purposes. As noted above, however, while some of cameras 202 may be fixed, others may be mounted on movable components. For example, a camera 202*a* is illustrated disposed on a spray device such as tubular spray element 198*a*, and it will be appreciated that the field of view of the camera may be controlled by a tubular spray element drive. As another example, camera 202*b* is illustrates as being disposed on a movable gantry 206, which permits horizontal and/or vertical movement of the camera. It will be appreciated that a camera may be movable and/or translatable in any number of directions and/or axes in different embodiments based upon the desired application of such camera, so the invention is not limited to the specific arrangement of cameras disclosed herein.

Tubular Spray Element Position Detection

As noted above, it may be desirable in some embodiments to additionally incorporate one or more position sensors to determine the position of a tubular spray element or other sprayer in a dishwasher. Position sensor 122 of FIG. 4, for example, is an encoder or hall sensor; however, in other embodiments, it may be desirable to utilize other position sensor implementations. It will be appreciated that due to the discrete control of a spray pattern available when utilizing tubular spray elements and other types of controllable sprayers, an ability to control and sense the trajectory of washing fluid within a dishwasher is desirable in many embodiments, as doing so may improve the effectiveness of a wash cycle, reduce cycle times, and facilitate the performance of additional operations that have heretofore not been possible in conventional dishwasher designs.

Figure 7:
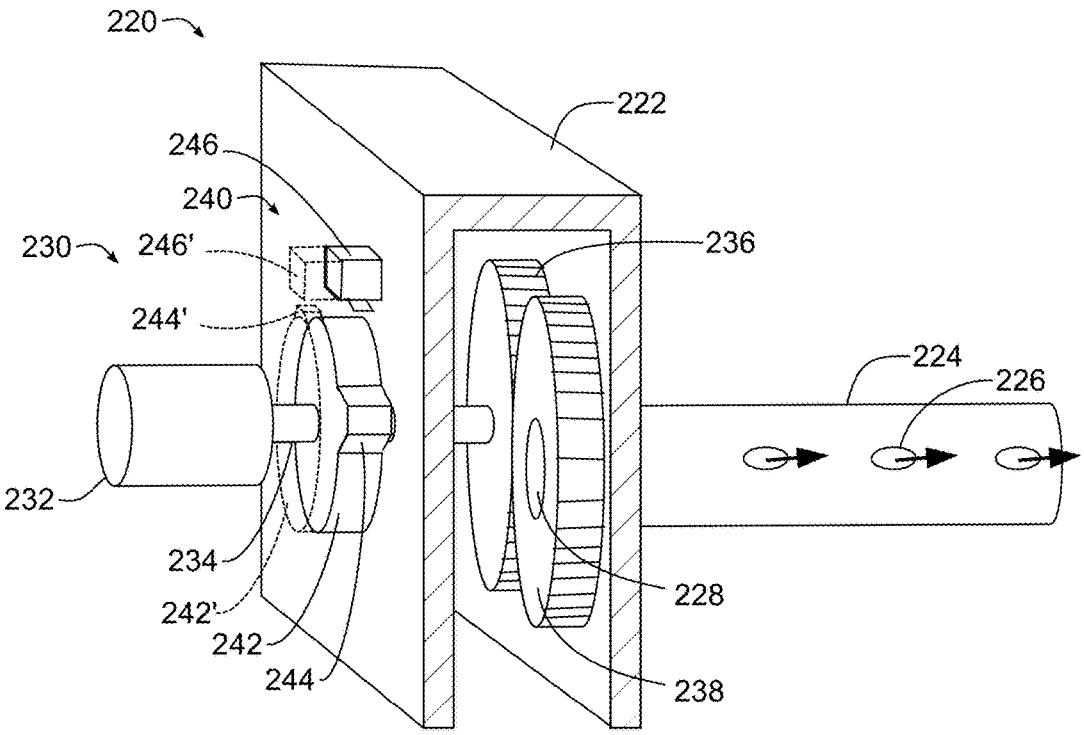
FIG. 7 is a partial cross-sectional view of a tubular spray element and tubular spray element drive incorporating a cam-based position sensor consistent with the invention.
Figure 8:
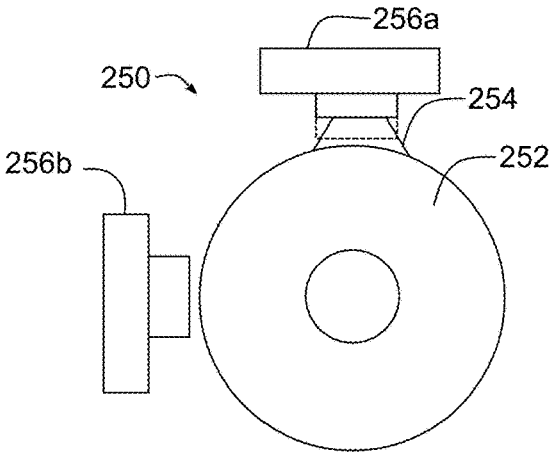
FIG. 8 is a functional end view of an alternative cam-based position sensor to that illustrated in FIG. 7, and incorporating multiple cam detectors.
Figure 9:
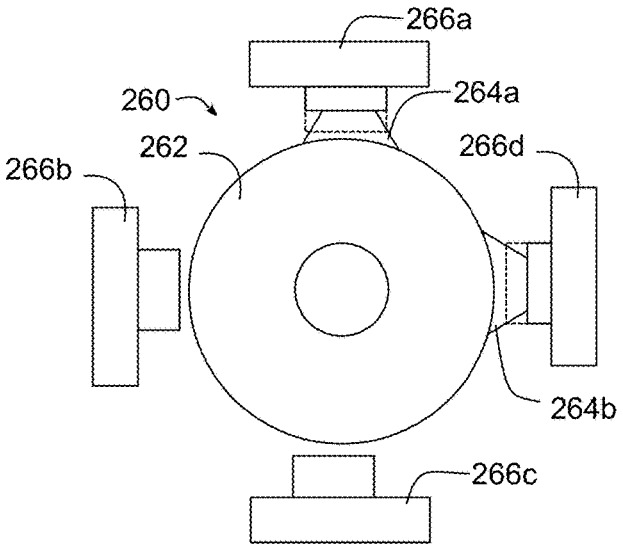
FIG. 9 is a functional end view of another alternative cam-based position sensor to that illustrated in FIG. 7, and incorporating multiple cam detectors and a cam with multiple lobes.

FIGS. 7-9, for example, discloses various cam-based position sensor implementations whereby one or more cams that rotate in connection with rotation of a tubular spray element may be sensed by one or more cam detectors to determine a current rotational position of a tubular spray element. In some embodiments, for example, a cam-based position sensor may be configured to sense multiple rotational positions among a plurality of rotational positions to which a tubular spray element drive may rotate an associated tubular spray element, and may include one or more cam detectors and a plurality of cam lobes operably coupled to the tubular spray element to rotate therewith.

FIG. 7, for example, illustrates a portion of a dishwasher 220 where a manifold 222 configured to be mounted on a side or rear wall of dishwasher 220 (not shown in FIG. 7) supports a tubular spray element 224 having one or more nozzles 226 configured to spray in a predetermined direction represented by the arrows in FIG. 7. Manifold 222 is in a fluid communication with a fluid supply (not shown) to convey fluid to tubular spray element 224 through an inlet port 228, and it will be appreciated that tubular spray element 224 is rotatably mounted to manifold 222 but is generally not removable therefrom. It will be appreciated however that the techniques described herein may also be used in connection with a dockable tubular spray element that is removable from a docking arrangement, e.g., where a tubular spray element is rack-mounted.

A tubular spray element drive 230 includes a motor 232, drive shaft 234 that projects through the wall of manifold 222 and a drive gear 236 that engages with a gear 238 that rotates with tubular spray element 224, such that rotation of drive shaft 234 by motor 232 rotates tubular spray element 224 through the engagement of gears 236, 238. While gears 236, 238 are illustrated as being within manifold 222, in other embodiments, the gears may be external from manifold 222, e.g., on the same side as motor 232, or alternatively, within the wash tub and on the same side as tubular spray element 224.

A cam-based position sensor 240 includes a cam 242 mounted to drive shaft 234 and including a cam lobe 244 defined at a rotational position relative to nozzles 226 of tubular spray element, e.g., at the same rotational position as nozzles 226 in some embodiments. A cam detector 246, e.g., a microswitch, is also positioned at a predetermined position about cam 242 and positioned within a path of travel of cam lobe 244 such that when cam 242 is rotated to a position whereby cam lobe 244 physically engages cam detector 246, a switch is closed and a signal is generated indicating that the tubular spray element 224 is at a predetermined rotational position. In the illustrated embodiment, for example, cam detector 246 is positioned at a top vertical position such that cam detector 246 generates a signal when nozzles 226 are directed straight upwards.

To simplify the discussion, it may be assumed that gears 236, 238 are identically configured such that tubular spray element 224 rotates a full revolution in response to rotation of drive shaft 234 by a full revolution, whereby the rotational position of tubular spray element 224 is derivable directly from the rotational position of drive shaft 234. In other embodiments, however, gears 236, 238 may be differently configured such that a full rotation of drive shaft 234 rotates tubular spray element by less than or more than a full revolution.

It will be appreciated that a cam detector in other embodiments may utilize other sensing technologies. For example, a cam detector may be implemented as a hall or magnetic sensor, and cam lobes on a cam may be implemented using magnets that are sensed by the hall or magnetic sensor when adjacent thereto. As another alternative, a cam detector may include one or more electrical contacts that close an electrical circuit when a cam lobe formed of metal or another electrical conductor engages the cam detector, or may include optical components that sense light or the blockage of light from different holes or durations.

Moreover, while position sensing is performed using a cam coupled to a drive shaft in the embodiment of FIG. 7 (such that the cam lobe(s) thereof rotate about an axis of rotation that is both coincident with the drive shaft and parallel to and offset from the longitudinal axis of the tubular spray element), in other embodiments, position sensing may be performed directly on tubular spray element 224 or a component that rotates therewith. FIG. 8, for example, illustrates an end view of a tubular spray element 250 including an integrated cam 252 including a single cam lobe 254, whereby cam lobe 254 rotates about an axis of rotation that is coincident with the longitudinal axis of tubular spray element 250.

FIG. 8 also illustrates another variation whereby multiple cam detectors, here cam detectors 256*a* and 256*b*, may be disposed around the perimeter of cam 252 to sense multiple rotational positions. Cam detectors may be placed at a multitude of rotational positions and for a multitude of purposes, e.g., to detect a "home" position, to detect rotational position corresponding to an "off" position for the tubular spray element (e.g., where an associated valve for the tubular spray element that is actuated through rotation of the tubular spray element is rotated to an off or closed position), to detect a deflector alignment position, to detect a "limit" position corresponding to a range limit (e.g., when it is desirable to define ranges where a tubular spray element should not be pointed, such as a wall of the wash tub), or to detect various "zones" in a dishwasher rack where it may be desirable to focus washing.

It will also be appreciated that a cam-based position sensor may include multiple cam lobes used with one or more cam detectors, and that these multiple cam lobes may rotate about a common axis and within a common plane (as is illustrated in FIG. 9), or alternatively, about a common axis and within different planes (as is illustrated in phantom in FIG. 7).

FIG. 9, for example, illustrates another variation whereby multiple cam lobes are disposed on a cam, and one or more cam detectors are used to sense the multiple cam lobes. In this implementation, a tubular spray element 260 includes a cam 262 integrated therewith and including multiple cam lobes 264*a*, 264*b* defined at different rotational positions. Moreover, while a single cam detector may be used in some embodiments, in the illustrated embodiment four cam detectors 266*a*, 266*b*, 266*c* and 266*d* are disposed at ninety degree increments around cam 262. It will be appreciated that in this implementation, four separate positions may be distinguished from one another based upon the combination of inputs from cam detectors 266*a-d*, since each ninety degrees of rotation will engage a different pair of cam detectors. Other numbers and positions of cam detectors and cam lobes may be used in other embodiments, so the invention is not limited to the particular implementations illustrated herein.

Returning to FIG. 7, it will also be appreciated that multiple cams may also be used in some embodiments, For example, a second cam 242' having a second cam lobe 244' and sensed by a second cam detector 246' are shown in phantom to support an ability to sense additional rotational positions. Second cam 242' rotates in a separate plane from cam 242, and thus a "stack" of two or more coaxial cams may be used in some embodiments to provide greater flexibility in terms of position sensing, particularly where discrimination between multiple distinct positions is desired.

Figure 10:
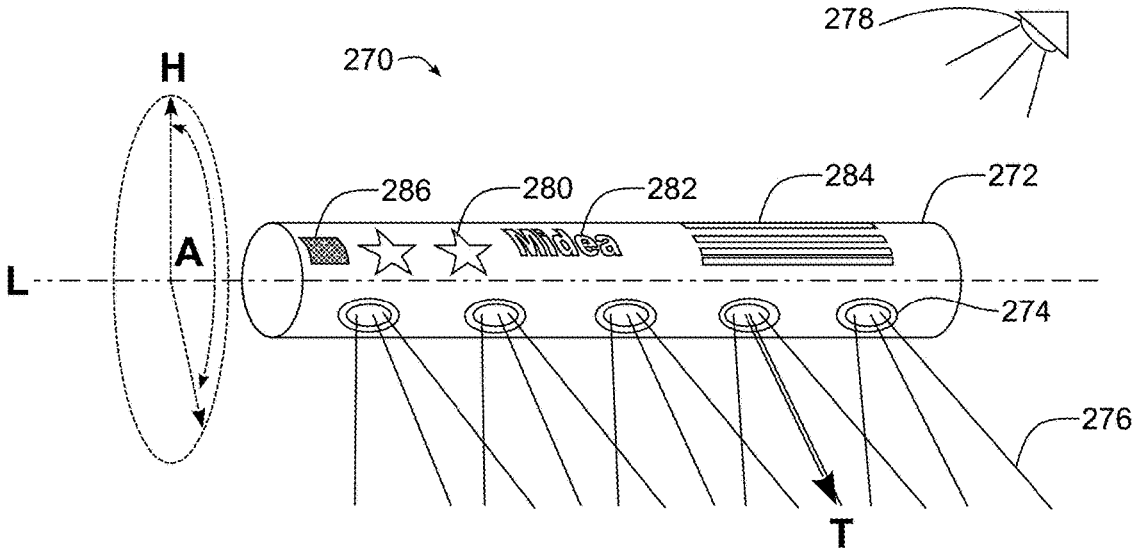
FIG. 10 is a functional perspective view of a tubular spray element and imaging system incorporating an image-based position sensor consistent with the invention.
Figure 11:
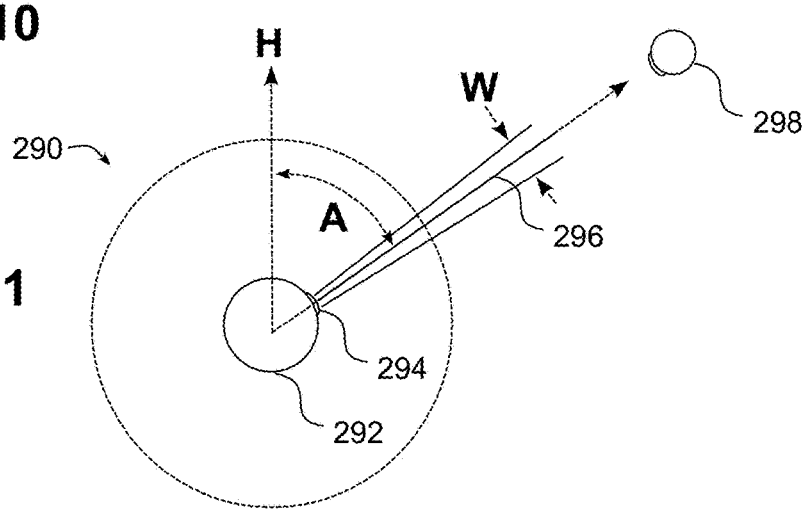
FIG. 11 is a functional end view of an alternative image-based position sensor to that illustrated in FIG. 10.
Figure 12:
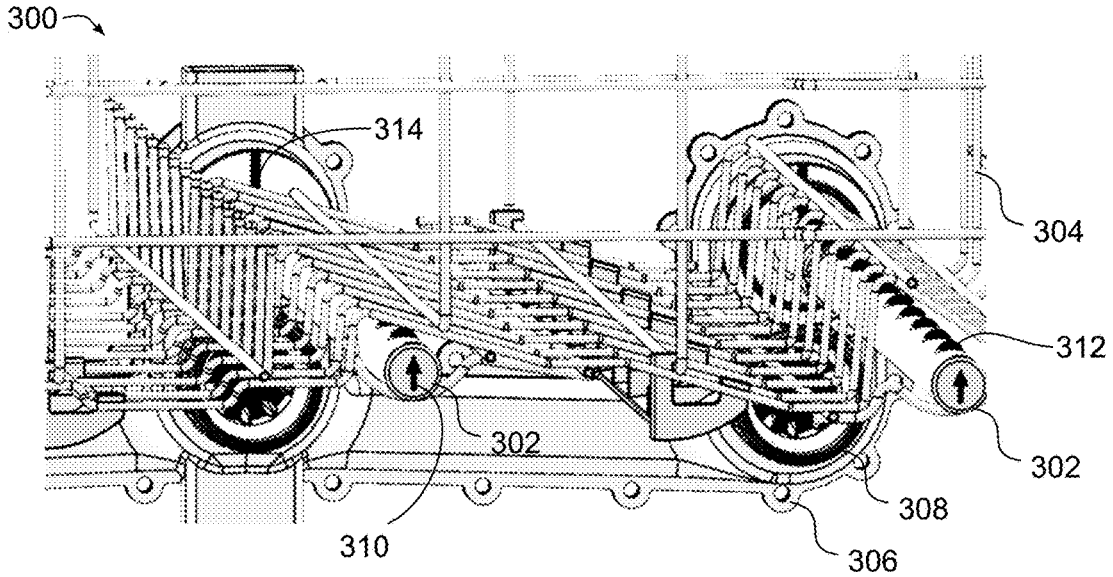
FIG. 12 is a perspective view of a dishwasher including a rack and a plurality of rack-mounted tubular spray elements incorporating distinctive features for use in image-based position sensing consistent with the invention.

Now turning to FIGS. 10-12, as an alternative to cam-based position sensing, image-based position sensing may be used in some embodiments of the invention, e.g., utilizing any of the various imaging system implementations described above. It will be appreciated, for example, that imaging systems may be utilized in dishwashers for other purposes, and as such, utilizing these imaging systems additionally to sense the rotational positions of tubular spray elements and/or other controllable sprayers in a dishwasher may be beneficial in some embodiments as doing so may reduce the number of sensors used to control tubular spray elements, lower costs and/or simplify a tubular spray element drive design.

FIG. 10, for example, illustrates an example dishwasher 270 including a tubular spray element 272 including a plurality of nozzles 274 that emit a spray pattern 276 generally along a trajectory T. A camera 278 or other imaging device may be positioned with tubular spray element 272 within its field of view to capture images of the tubular spray element during use. In some embodiments, multiple cameras 278 may be used to capture the tubular spray element from multiple viewpoints, while in other embodiments a single camera may be used.

A rotational position of tubular spray element 272 may be defined about its longitudinal axis L, and in some embodiments may be represented using an angle A relative to some home position H (e.g., a top vertical position in the illustrated embodiment, although the invention is not so limited).

The rotational position of tubular spray element 272 may be detected from image data based upon image analysis of one or more images captured from one or more image devices, and in many embodiments, may be based upon detecting one or more visually distinctive features that may be used to determine the current orientation of the tubular spray element about its longitudinal axis L. In some embodiments, for example, distinctive structures defined on the generally cylindrical surface of tubular spray element 272, e.g., nozzles 274, may be detected in order to determine the rotational position.

In other embodiments, however, distinctive indicia 280 that are incorporated into tubular spray element 272 solely or at least partially for purposes of image-based position sensing may be disposed at various rotational positions on the outer surface of tubular spray element 272. In addition, in some instances, as illustrated at 282, the distinctive indicia may be textual in nature. Furthermore, as illustrated at 284, the distinctive indicia may be designed to represent a range of rotational positions, such that image analysis of the indicia may be used to determine a specific rotational position within the range. Indicia 284, for example, includes a series of parallel bars that vary in width and/or spacing such that a location within the series of parallel bars that is visible in a portion of an image can be used to determine a particular rotational position, similar in many respects to the manner that a bar code may be used to retrieve numerical information irrespective of the orientation and/or size of the bar code in an image. Other indicia arrangements that facilitate discrimination of a rotational position out of a range of rotational positions may also be used in some embodiments, e.g., combinations of letters or numbers. In some embodiments, for example, an array of numbers, letters or other distinctive features may circumscribe the generally cylindrical surface of a tubular spray element such that a rotational position may be determined based upon the relative position of one or more elements in the array.

The indicia may be formed in varying manners in different embodiments, e.g., formed as recessed or raised features on a molded tubular spray element, formed using contrasting colors or patterns, integrally molded with the surface of the tubular spray element, applied or otherwise mounted to the surface of the tubular spray element using a different material (e.g., a label or sticker), or in other suitable manners. For example, a reflective window 286 may be used in some embodiments to reflect light within the washtub and thereby provide a high contrast feature for detection. Further, in some embodiments an indicia may itself generate light, e.g., using an LED. It will be appreciated that in some instances, fluid flow, detergent, and/or obstructions created by racks and/or utensils may complicate image-based position sensing, so high contrast indicia may be desirable in some instances to accommodate such challenging conditions.

With reference to FIG. 11, it will also be appreciated that image-based position sensing may also be based on sensing the actual fluid flow or spray pattern of fluid emitted by a tubular spray element. FIG. 11, in particular, illustrates a dishwasher 290 including a tubular spray element 292 with nozzles 294 that emit a spray pattern 296. Through appropriate positioning of a camera, an angle A relative to a home position H, and in some instances, a spray pattern width W, may be sensed via image-based position sensing. While a camera positioned to view generally along the longitudinal axis of the tubular spray element has a field of view well suited for this purpose, it will be appreciated that other camera positions may also be used.

In addition, in some embodiments, image-based position sensing may also be based upon the relationship of a spray pattern to a target, e.g., the example target 298 illustrated in FIG. 11, which may be, for example, disposed on a rack, on a tub wall, or another structure inside a dishwasher and having one or more visually-identifiable indicia disposed thereon. As will become more apparent below, in some embodiments it may be desirable to utilize a target in order to calibrate a tubular spray element drive, e.g., by driving the tubular spray element 292 to an expected position at which the spray pattern 296 will hit the target 298, determining via image analysis whether the spray pattern 296 is indeed hitting the target, and if not, adjusting the position of the tubular spray element to hit the target and updating the tubular spray element drive control accordingly.

Now turning to FIG. 12, it will also be appreciated that indicia may also be positioned on other surfaces of a tubular spray element and/or on other components that move with the tubular spray elements. FIG. 12 in particular illustrates a dishwasher 300 including multiple tubular spray elements 302 supported by a rack 304 and engaged with a docking arrangement 306 disposed on a back wall of the dishwasher tub, and including one or more rotatable docking ports 308. In this embodiment, an indicia, e.g., an arrow 310, may be disposed on an end surface of a tubular spray element 302, and may be oriented such that the arrow tip may be aligned with the nozzles 312 of the tubular spray element (or any other rotational position of the tubular spray element), such that image analysis of the arrow indicia may be used to determine a rotational position of the tubular spray element. It will also be appreciated that other indicia that present visually distinct orientations throughout the rotation of the tubular spray element may be used as an alternative to an arrow indicia.

In addition, nozzles 312 are illustrated in a contrasting color that may also be used to determine the rotational position. Furthermore, each tubular spray element 302 is illustrated with an indicia (a contrasting line) 314 disposed on a docking component of the tubular spray element, which may also be used in image-based position sensing in some embodiments. Other components, e.g., gears, or rotatable components of a docking arrangement, may also include distinct indicia to facilitate position sensing in other embodiments. Furthermore, multiple colors may be used at different locations about the circumference of a tubular spray element to facilitate sensing in some embodiments.

Figure 13:
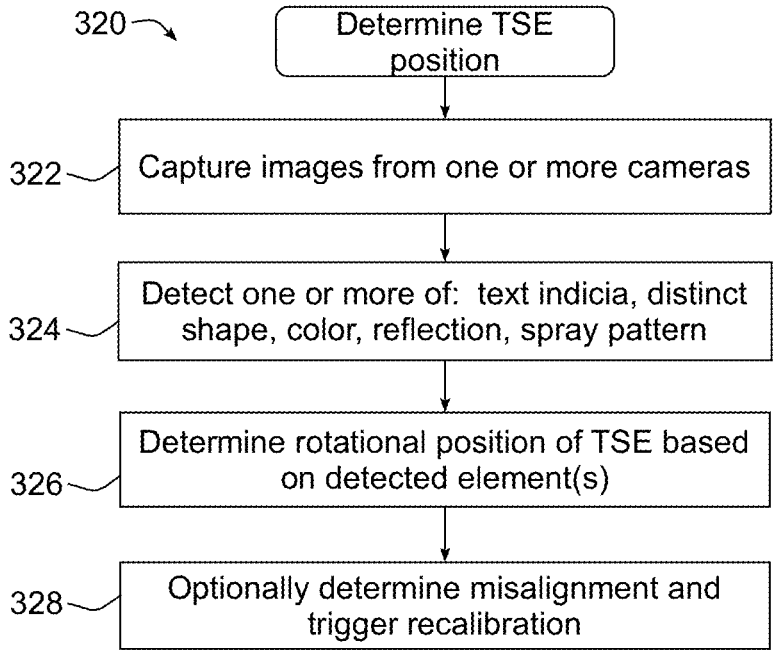
FIG. 13 is a flowchart illustrating an example sequence of operations for determining a rotational position of a tubular spray element during a wash cycle using an image-based position sensor consistent with the invention.

An example process for performing image-based position sensing consistent with the invention is illustrated at 320 in FIG. 13. In order to determine rotational position, one or more images may be captured from one or more cameras having fields of view that encompass at least a portion of the tubular spray element in block 322, and any of the aforementioned types of visually distinctive features (indicia, shapes, text, colors, reflections, spray patterns) may be detected in the image(s) in block 324. The rotational position is then determined in block 326 based upon the detected elements.

It will be appreciated that a rotational position may be determined from the detected elements in a number of manners consistent with the invention. For example, various image filtering, processing, and analysis techniques may be used in some embodiments. Further, machine learning models may be constructed and trained to identify the rotational position of a tubular spray element based upon captured image data. A machine learning model may be used, for example, to determine the position of a visually distinctive feature in block 324, to determine the rotational position given the position of a visually distinctive feature in block 326, or to perform both operations to effectively output a rotational position based upon input image data.

In addition, in some embodiments, it may be desirable to monitor for misalignments of a tubular spray element to trigger a recalibration operation. In block 328, for example, if it is known that the position to which the tubular spray element is being driven differs from the sensed position, a recalibration operation may be signaled such that, during an idle time (either during or after a wash cycle) the tubular spray element is recalibrated. In some embodiments, for example, image analysis may be performed to detect when a spray pattern is not hitting an intended target when the tubular spray element is driven to a position where it is expected that the target will be hit. In some embodiments, such analysis may also be used to detect when the spray pattern has deviated from a desired pattern, and recalibration of a flow rate may also be desired (discussed in greater detail below).

Figure 14:
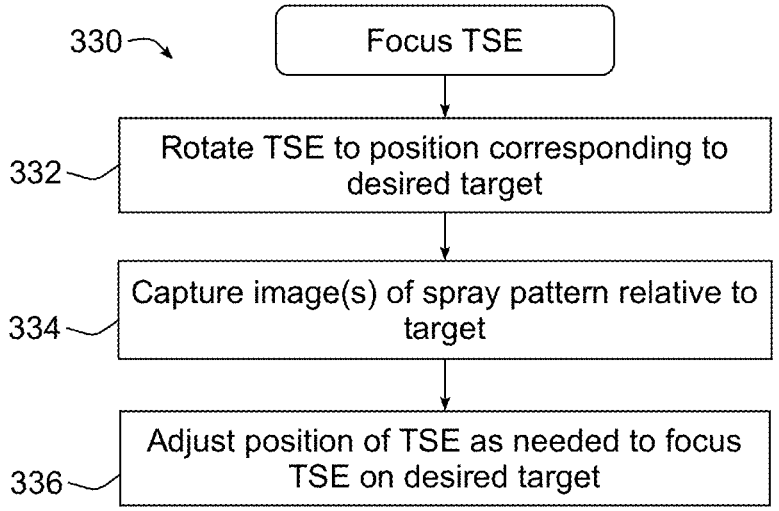
FIG. 14 is a flowchart illustrating an example sequence of operations for focusing a tubular spray element consistent with the invention.

Now turning to FIG. 14, it may also be desirable to use image-based position sensing to direct a tubular spray element to direct spray on a particular target, whereby a positional relationship between a spray pattern and a target may be used to control the rotational position of a tubular spray element. For example, as illustrated by process 330, a tubular spray element may be focused on a particular target by, in block 332, first rotating the tubular spray element to a position corresponding to a desired target, e.g., using process 320 to monitor TSE position until a desired position is reached. The target may be a particular component in the dishwasher, or a particular utensil in the dishwasher, or even a particular location on a component or utensil in the dishwasher (e.g., a particular spot of soil on a utensil). The target location may be determined, for example, based upon image analysis of one or more images captured in the dishwasher (from which, for example, a desired angle of spray is determined from the previously known position of a tubular spray element), or based upon a previously-known rotational position corresponding to a particular target (e.g., where it is known that the silverware basket is between 120 and 135 degrees from the home position of a particular tubular spray element).

Next, once the tubular spray element is rotated to the desired position, one or more images are captured in block 334 while a spray pattern is directed on the target, and image analysis is performed to determine whether the spray pattern is hitting the desired target. If so, no adjustment is needed. If not, however, block 336 may adjust the position of the tubular spray element as needed to focus the tubular spray element on the desired target, which may include continuing to capture and analyze images as the tubular spray element is adjusted.

While image-based position sensing may be used in some embodiments to detect a current position of a tubular spray element in all orientations, in other embodiments it may be desirable to use image-based position sensing to detect only a subset of possible rotational positions, e.g., as little as a single "home" position. Likewise, as noted above, cam-based position sensing generally is used to detect only a subset of possible rotational positions of a tubular spray element. In such instances, it may therefore be desirable to utilize a time-based control where, given a known rate of rotation for a tubular spray element, a tubular spray element drive may drive a tubular spray element to different rotational positions by operating the tubular spray element drive for a predetermined amount of time associated with those positions (e.g., with a rate of 20 degrees of rotation per second, rotation from a home position at 0 degrees to a position 60 degrees offset from the home position would require activation of the drive for 3 seconds). Given a rotation rate of a tubular spray element drive (e.g., in terms of Y degrees per second) and a desired rotational displacement X from a known rotational position sensed by a position sensor, the time T to drive the tubular spray element drive after sensing a known rotational position is generally T=X/Y.

Figure 15:
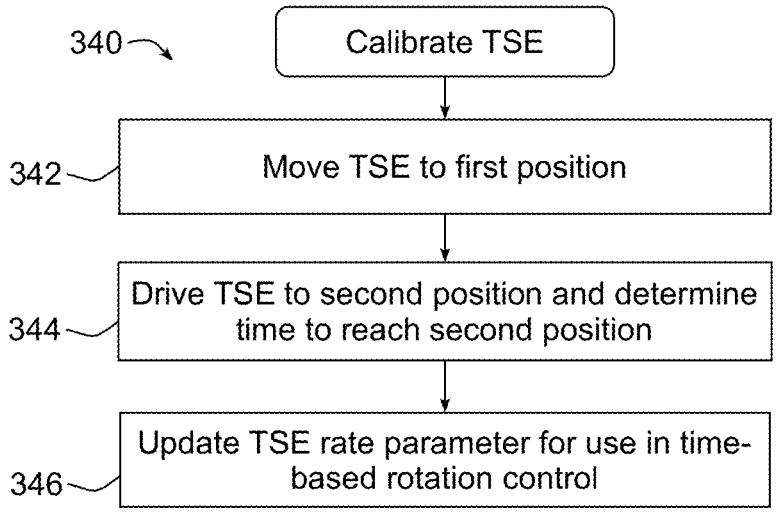
FIG. 15 is a flowchart illustrating an example sequence of operations for calibrating a tubular spray element consistent with the invention.

In order to determine the rotation rate of a tubular spray element, a calibration process, e.g., as illustrated at 340 in FIG. 15, may be used. It will be appreciated that calibration may be performed during idle times or during various points in a wash cycle, and may be performed in some instances while fluid is being expelled by a tubular spray element, or in other instances while no flow of fluid is provided to the tubular spray element. In addition, in some embodiments, different tubular spray elements may be calibrated at different times, while in other embodiments calibration may be performed concurrently for multiple tubular spray elements. It will also be appreciated that, in some instances, wear over time may cause variances in the rate of rotation of a tubular spray element in response to a given control input to a tubular spray element drive, and as such, it may be desirable to periodically perform process 340 over the life of a dishwasher to update the rotation rate associated with a tubular spray element.

In process 340, a tubular spray element is driven to a first position (e.g., a home position as sensed by an image-based position sensor or corresponding to a particular cam detector/cam lobe combination of a cam-based position sensor) in block 342, and then is driven to a second position in block 344, with the time to reach the second position determined, e.g., based upon a timer started when movement to the second position is initiated. The second position may be at a known rotational position relative to the first position, such that the actual rotational offset between the two positions may be used to derive a rate by dividing the rotational offset by the time to rotate from the first to the second position. The rate may then be updated in block 346 for use in subsequent time-based rotation control.

In some embodiments, the first and second positions may be separated by a portion of a revolution, while in some embodiments, the first and second positions may both be the same rotational position (e.g., a home position), such that the rotational offset corresponds to a full rotation of the tubular spray element. In addition, multiple iterations may be performed in some embodiments with the times to perform the various iterations averaged to generate the updated rate.

Figure 16:
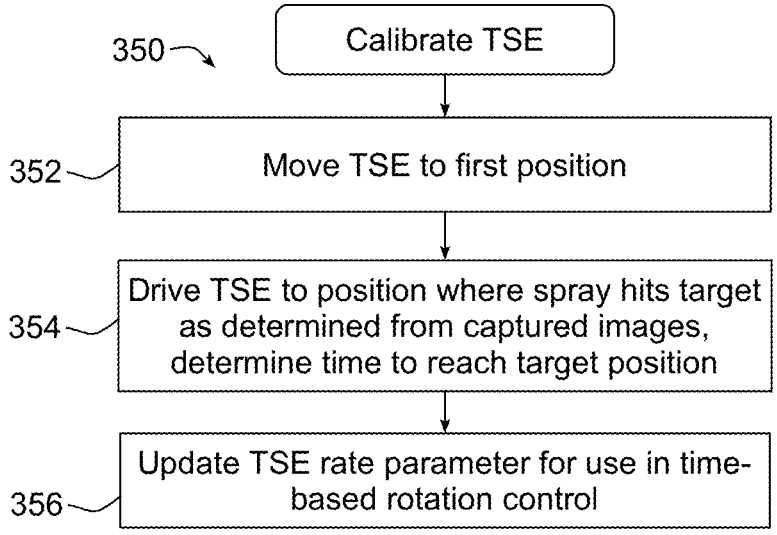
FIG. 16 is a flowchart illustrating another example sequence of operations for calibrating a tubular spray element.

As an alternative to process 340, calibration of a tubular spray element may be based upon hitting a target, as illustrated by process 350 of FIG. 16. In this process, the tubular spray element is driven to a known first position, e.g., a home position, in block 352. Then, in block 354, the tubular spray element is driven while wash fluid is expelled by the tubular spray element until the spray pattern is detected hitting a particular target, e.g., similar to the manner discussed above in connection with FIG. 14. During this time, the amount of time required to rotate from the first position to the target position is tracked, and further based upon the known rotational offset of the target position from the first position, an updated rate parameter may be generated in block 356 for use in subsequent time-based rotation control.

Figure 17:
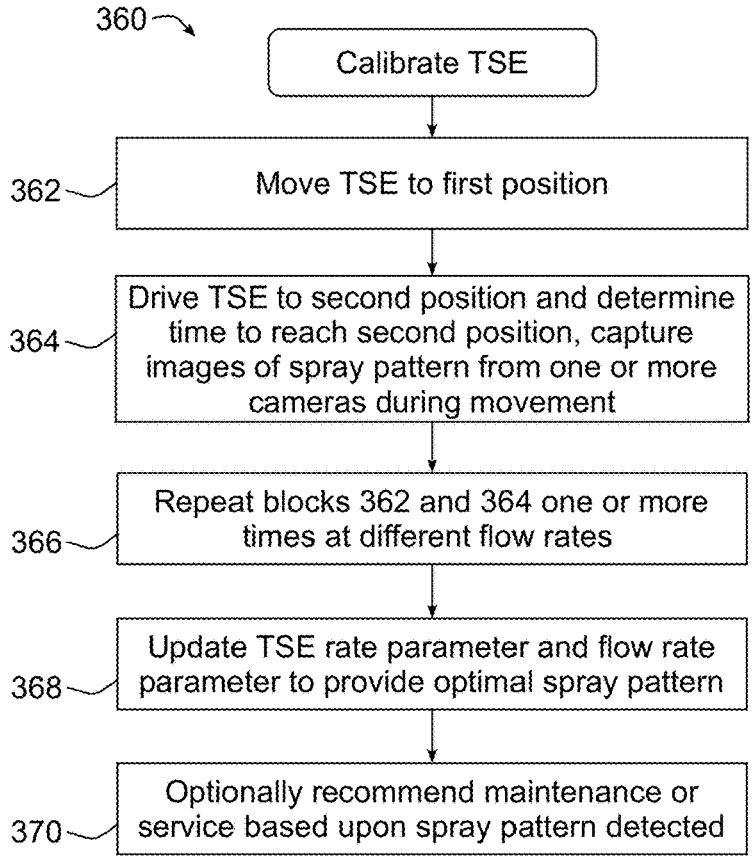
FIG. 17 is a flowchart illustrating yet another example sequence of operations for calibrating a tubular spray element, and incorporating image-based spray pattern analysis consistent with the invention.

FIG. 17 illustrates another example calibration process 360 suitable for use in some embodiments. Process 360, in addition to determining a rate of rotation, also may be used to assess a spray pattern of a tubular spray element and generate a flow rate parameter that may be used to control a variable valve that regulates flow through the tubular spray element, or alternatively control a flow rate for a fluid supply that supplies fluid to the tubular spray element. In particular, it will be appreciated that since solids build up over time with wash cycles (e.g., due to hard water and soils), it may be desirable to include a calibration mode where a dishwasher runs through a series of operations while visually detecting the rotational positions of the tubular spray elements. This collected information can serve a purpose of determining any degradation of rotational speed and/or change in exit pressure of wash liquid from the tubular spray elements over time. The calibration may then be used to cause a modification in rotational speed and/or exit pressure of water (e.g., via changes in flow rate) from the tubular spray elements in order to optimize a wash cycle.

Process 360 begins in block 362 by moving the tubular spray element to a first position. Block 364 then drives the tubular spray element to a second position and determines the time to reach the second position. In addition, during this time images are captured of the spray pattern generated by the tubular spray element. Next, in block 366, blocks 362 and 364 are repeated multiple times, with different flow rates supplied to the tubular spray element such that the spray patterns generated thereby may be captured for analysis. Block 368 then determines a rate parameter in the manner described above (optionally averaging together the rates from the multiple sweeps).

In addition, block 368 may select a flow rate parameter that provides a desired spray pattern. In some embodiments, for example, the spray patterns generated by different flow rates may be captured in different images collected during different sweeps, and the spray patterns may be compared against a desired spray pattern, with the spray pattern most closely matching the desired spray pattern being used to select the flow rate that generated the most closely matching spray pattern selected as the flow rate to be used. In addition, analysis of spray patterns may also be used to control rate of rotation, as it may be desirable in some embodiments to rotate tubular spray elements at slower speeds to increase the volume of fluid directed onto utensils and thereby compensate for reduced fluid flow. Further, in some embodiments, pressure strength may be measured through captured images. As one example, a tubular spray element may be rotated to an upwardly-facing direction and the height of the spray pattern generated may be sensed via captured images and used to determine a relative pressure strength of the tubular spray element.

In addition, as illustrated in block 370, it may be desired in some embodiments to optionally recommend maintenance or service based upon the detected spray patterns. For example, if no desirable spray patterns are detected, e.g., due to some nozzles being partially or fully blocked, it may be desirable to notify a customer of the condition, enabling the customer to either clean the nozzles, run a cleaning cycle with an appropriate cleaning solution to clean the nozzles, or schedule a service. The notification may be on a display of the dishwasher, on an app on the user's mobile device, via text or email, or in other suitable manners.

Figure 18:
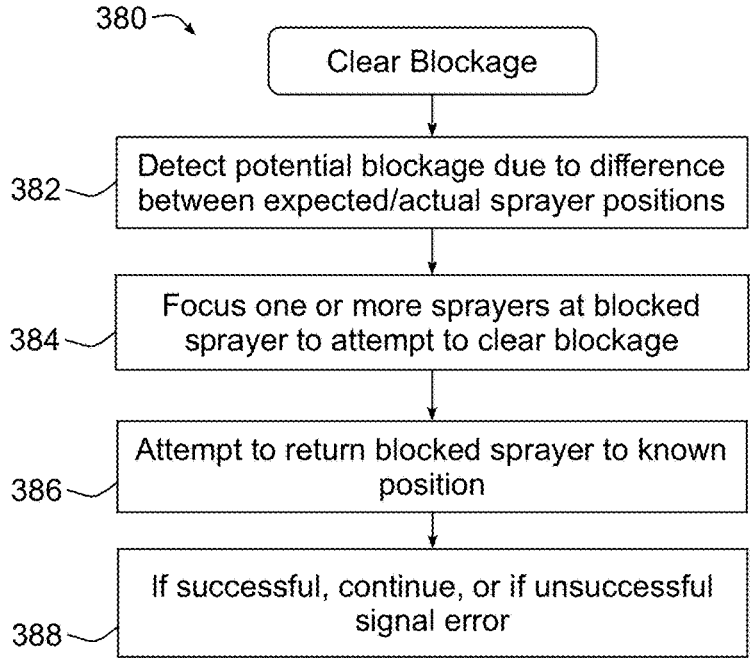
FIG. 18 is a flowchart illustrating an example sequence of operations for clearing a blockage in a sprayer consistent with the invention.

Now turning to FIG. 18, it may also be desirable in some embodiments to utilize position sensing to clear potential blockages in a tubular spray element. In a process 380, for example, a difference between sensed and expected rotational positions of a tubular spray element (or potentially of another type of controlled sprayer) may be detected in block 382, and may cause one or more tubular spray elements or other controlled sprayers to be focused on the blocked sprayers to attempt to clear the blockage. For example, if the gears or other drivetrain components for a controlled sprayer become blocked by food particles, other sprayers may be focused on the sprayer to attempt to clear the blockage.

After focusing spray on the blocked sprayer, block 386 may then attempt to return the blocked sprayer to a known position, and then monitor the position in any of the manners described above. Then, in block 388, if the movement is successful, the wash cycle may resume in a normal manner, and if not, an error may be signaled to the user, e.g., in any various manners mentioned above, for maintenance or service.

Dishwasher Thermal Imaging System

In some embodiments of the invention, it may also be desirable to utilize a thermal imaging system in a dishwasher to evaluate temperature conditions within of a dishwasher during a wash cycle for the purposes of optimizing performance of the dishwasher. The thermal imaging system may include one or more thermal imaging cameras or other thermal imaging devices disposed within the dishwasher and capable of utilizing thermography to sense infrared radiation emitted from objects within a field of view of the thermal imaging system, generally with the intensity of such infrared radiation varying with temperature. The images captured by a thermal imaging device, which are referred to hereinafter as thermal images, are generally two dimensional representations of a field of view of the thermal imaging device, with the value of each pixel in the thermal image being representative of the infrared energy detected at the corresponding position in the field of view.

Image analysis may be performed on thermal images to determine temperature and/or identify temperature variances within thermal images to assist in discriminating between different objects and/or different features of an object.

In one embodiment discussed hereinafter, for example, thermal imaging may be used to detect the temperature of utensils placed in a dishwasher, e.g., dishware, drinkware, silverware, pots, pans, baking sheets, baby bottles, pitchers, knives, tools, e.g., for the purpose of monitoring the dryness of the utensils. Thermal imaging may also be used in some embodiments to sense the temperature of a wash fluid disposed in a sump to regulate the output of a heating element disposed in the sump.

In still other embodiments, thermal imaging may be used to detect the presence of water drops on utensils based in part on a temperature variance between the temperatures of the water drops and the utensils upon which the water drops are disposed. It will be appreciated that, with conventional imaging techniques, water drops disposed on utensil surfaces may be difficult to detect due to the fact that water is transparent and thus water drops are not particularly visually distinctive when disposed on a surface, particularly a transparent or translucent surface such as glass or plastic. However, water has a different thermal conductivity than the materials used in many utensils, e.g., silverware, metal pots and pans, glassware, plastic utensils, etc., and as such, as the environment within a wash tub is heated or cooled, the different thermal conductivities will generally result in differing rates of heating or cooling of water drops and the surfaces of various utensils upon which such water drops are disposed. As such, during heating or cooling of the utensils, water drops on such utensils will generally differ at least temporarily in temperature from the surfaces upon which they are disposed, and thus thermal images captured of such surfaces may, in some circumstances, include regions of differing temperatures on the surfaces of utensils that are indicative of water drops.

Thermal imaging may be used in different embodiments to configure a wash cycle in different manners. In some instances, for example, thermal imaging may be used to configure various settings of a wash cycle, e.g., numbers and/or durations of operations such as wash operations, rinse operations, drying operations, soak operations, etc.; temperature settings used in various operations; fluid volumes used in various operations; etc. Thermal imaging may also be used in some instances in the control of one or more controllably-movable sprayers, e.g., to direct wash fluid onto a particular target, to direct a spray of air onto a particular target, etc.

Figure 19:
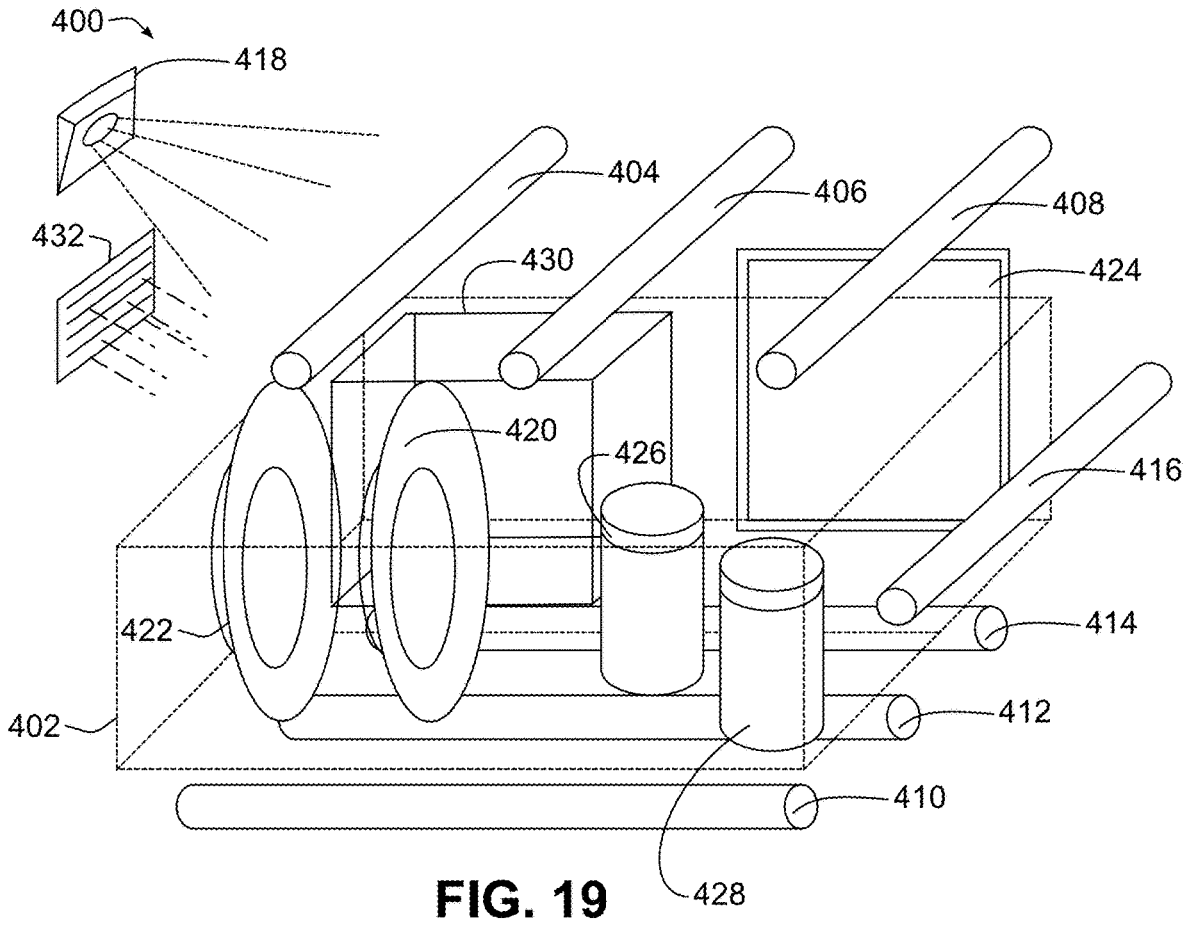
FIG. 19 is a functional perspective view of a dishwasher including a thermal imaging system consistent with some embodiments of the invention.

Now turning to FIG. 19, this figure illustrates a portion of a dishwasher 400 including a rack 402 surrounded by a series of controllably-movable sprayers, here tubular spray elements 404-416. Tubular spray elements 404, 406 and 408 are disposed above rack 402, tubular spray elements 410, 412 and 414 are disposed below rack 402, and tubular spray element 416 is disposed to the side of rack 402, with tubular spray elements 410-414 running generally transverse to tubular spray elements 404-408 and 416. In addition, a thermal imaging device 418 of a thermal imaging system, here configured as a single wall-mounted and fixed thermal camera, is used to capture thermal images of rack 402. It will be appreciated that different numbers, locations, types and/or orientations of controllably-movable sprayers and/or imaging devices may be used in other embodiments, so the invention is not limited to the particular configuration illustrated in FIG. 19. Moreover, as some embodiments of the invention may utilize thermal imaging separate from the control of any sprayer, it will be appreciated that thermal imaging consistent with the invention may be utilized in connection with dishwashers having conventional spray arrangements such as one or more rotatable spray arms.

For the purposes of the subsequent discussion, rack 402 is illustrated housing a number of utensils 420-428, including two ceramic plates 420, 422, a metal baking sheet 424, and two plastic drinking glasses 426, 428. It will also be appreciated that rack 402 may include additional structures, e.g., a silverware basket 430, within which silverware, knives and other cooking implements may be placed for washing.

In the illustrated embodiment of FIG. 19, thermal imaging is used in connection with configuring a drying operation performed at the end of a wash cycle. In various embodiments, dishwasher 400 may utilize various drying techniques, e.g., heated drying, where air is circulated around the utensils to dry via convection, condensation drying, where utensils are sprayed with hot water at the end of the wash cycle and the relatively cooler structure of the wash tub causes moisture to condense on the surfaces of the wash tub, or other techniques that will be apparent to those of ordinary skill having the benefit of the instant disclosure.

Dishwasher 400 may also optionally include various components for use in connection with drying utensils at the end of a wash cycle. For example, dishwasher 400 may include an air vent 432 through which air is circulated to remove humidity from the wash tub. Alternatively, dishwasher 400 may include a heating element (not shown) in the sump, or in some embodiments, may include a drying agent. Dishwasher may also include a rinse aid dispenser in some embodiments, and in some embodiments, dishwasher 400 may also include an ability to automatically open the door. In still other embodiments, dishwasher 400 may utilize one or more controllable sprayers, e.g., one of tubular spray elements 404-416, to spray air on the utensils to assist with drying. Other drying components may also be used in other embodiments, as will be appreciated by those of ordinary skill having the benefit of the instant disclosure.

As noted above, in some embodiments temperature variances between different materials may be used to detect the presence of water drops on utensils. In some embodiments, for example, a condensation drying operation may be performed, where utensils are sprayed with a final hot rinse to heat up the utensils to an elevated temperature prior to drying. As utensils are generally constructed of materials that have different thermal conductivities from water, the rates at which the temperatures of the utensils decrease will generally differ from any water drops on the surfaces of such utensils, such that a thermal image captured of a utensil as it cools may, in some instances, be used to detect water drops on the utensil as regions where a temperature variance exists from the rest of the utensil.

Figure 20:
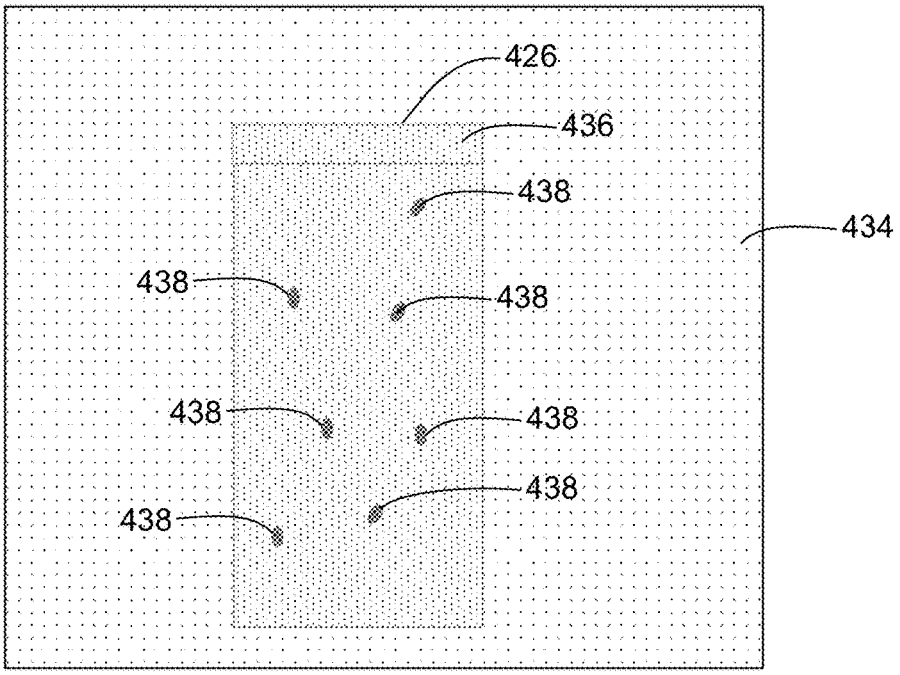
FIG. 20 is an example thermal image captured by the thermal imaging system of the dishwasher of FIG. 19.

FIG. 20, for example, illustrates an example thermal image 434 captured of plastic drinking glass 426, showing the surface temperature of glass 426 represented by a first infrared intensity value 436, and showing a plurality of regions 438 of relatively higher infrared intensity values representing water drops that are present on the surface of the glass as it is cooling. It will be appreciated that the temperature variances, and thus the detectability, of water drops on a utensil may vary based upon a number of factors, including, for example, the type of material, the thickness of the material, the initial temperature to which the utensil is heated, the elapsed time, etc. Some utensils, for example, may not be particularly suitable for water drop detection in some embodiments, particularly where the rate of temperature change of the utensil is relatively close to that of the water drops. The rates for other types of utensils, however, may vary considerably from that of water drops, thus facilitating detection. It has been found, in particular, that many plastic utensils, particularly thin-walled plastic utensils such as cups and storage containers, cool much quicker than water, so water drops may be comparatively more detectable on plastic utensils than on other types of utensils.

Water drop detection may be used, for example, to determine when a load of utensils is sufficiently dry. In some embodiments, for example, the absence of water drops may be an indicator that a load of utensils is dry, and in some embodiments, the absence of water drops may be based upon the disappearance of previously-detected water drops on particular utensils in a load. Particularly where a load contains utensils of different types, materials, etc., water drops may only be detectable on certain utensils in a load, and a dry condition may be indicated when the water drops that were previously detected on one or more utensils are no longer detected at a future point in a drying operation.

Figure 21:
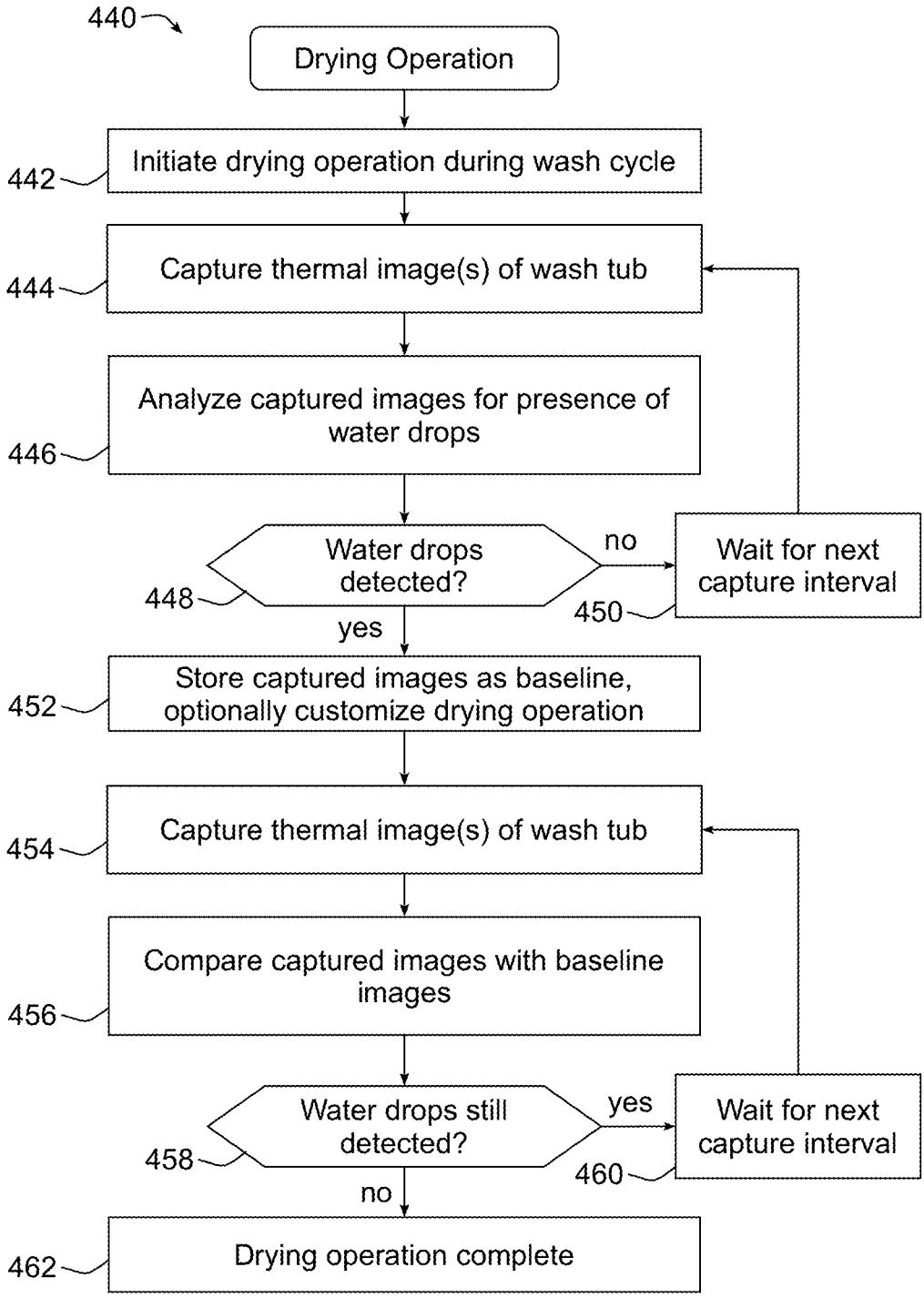
FIG. 21 is a flowchart illustrating an example sequence of operations for performing a drying operation using the dishwasher of FIG. 19.

FIG. 21, for example, illustrates an example implementation of a process 440 for performing a drying operation consistent with some embodiments of the invention. First, in block 442, the drying operation is initiated at some point in the wash cycle. For example, where condensation drying is used, the drying operation may be initiated after a final hot rinse is performed to heat the utensils in the dishwasher to an elevated temperature. Block 444 then initiates a loop to periodically capture one or more thermal images of the wash tub, or at least a region of the wash tub, e.g., one or more racks of utensils. Block 446 analyzes the captured images to attempt to detect the presence of one or more water drops.

The analysis performed in block 446 may be performed locally or remotely, and may be based upon detection of one or more regions of temperature variances in a thermal image, e.g., using a machine learning model trained to identify particular temperature variances indicative of water drops. In some embodiments, water drops may be detected based upon differences in intensity as well as size ranges and/or shapes indicative of water drops. Further, image analysis may further attempt to discriminate between utensils and non-utensils (e.g., wash tub walls, racks, and other dishwasher components) such that only the surfaces of objects identified as utensils are analyzed for the presence of water drops. Put another way, image analysis may be performed in some embodiments to identify a surface of one or more utensils such that water drops disposed on surfaces of non-utensil objects depicted in a thermal image may be ignored. In addition, in some embodiments thermal images may be combined with additional image data, e.g., collected from a visible spectrum imaging device, to facilitate the detection of utensil boundaries.

Block 448 next determines whether water drops have been detected, and if not, passes control to block 450 to wait for a next capture interval. At the next interval, control returns to block 444 to repeat thermal image capture and analysis. Thus, blocks 444-450 iterate until a sufficient temperature variance has occurred and water drops are detectable on one or more utensils.

Returning to block 448, once water drops are detected, control passes to block 452 to store the last-captured thermal image(s) as a baseline. In addition, at this time it may also be desirable to customize the drying operation based upon the detected water drops. For example, in some embodiments, a heating element temperature, a fan speed, or some other aspect of a drying operation may be varied based upon the quantity and/or locations of water drops. Also, in some embodiments, e.g., where controllably-movable sprayers such as tubular spray elements are used during a drying operation to spray air on utensils, the quantity and/or locations of water drops may be used to control where the sprayers direct air within the wash tub. In some instances, the locations of water drops may serve as targets to which air is sprayed onto a utensil to effectively blow off the water drops from the surface of the utensil.

Next, block 454 initiates a loop to periodically capture one or more thermal images of the wash tub, or at least a region of the wash tub, e.g., one or more racks of utensils. Block 456 then compares the captured images against the baseline images, and as long as the water drops are still detected, block 458 passes control to block 460 to wait for a next capture interval and return control to block 454 to repeat thermal image capture and comparison against the baseline images containing known water drops.

If, however, water drops are no longer detected, block 458 may pass control to block 462 to terminate the drying operation. Further, in some instances the drying operation may be terminated some predetermined time after water drops are no longer detected, e.g., to provide additional time for the drying operation to complete.

Figure 22:
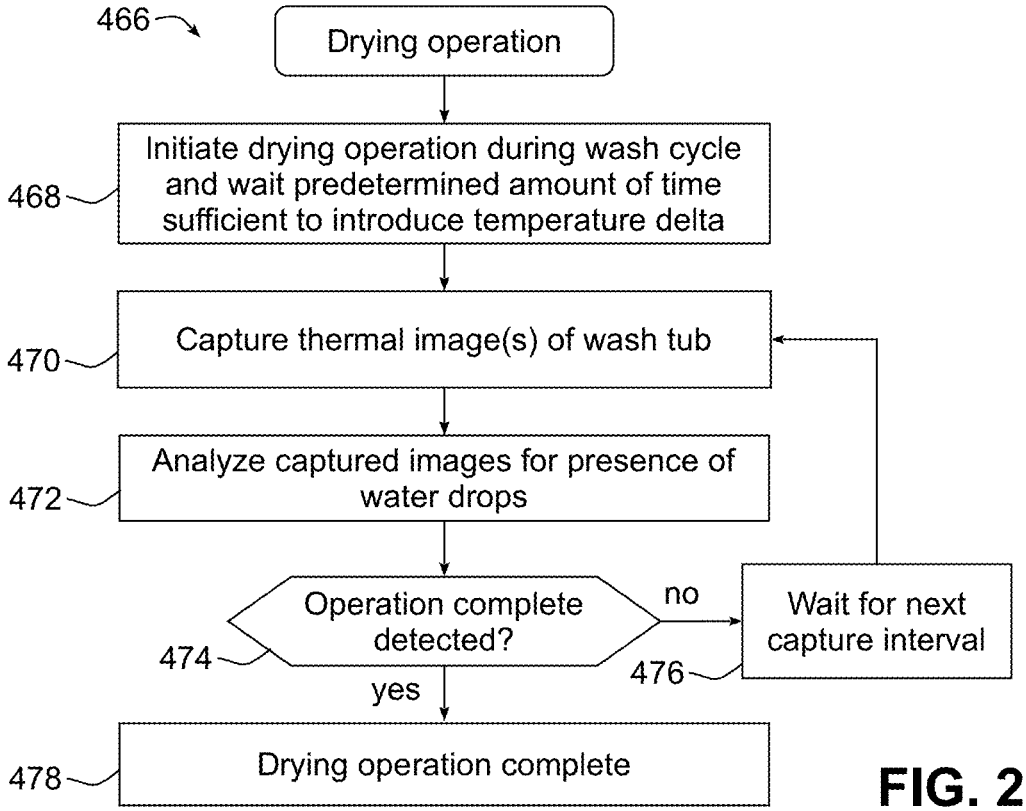
FIG. 22 is a flowchart illustrating another example sequence of operations for performing a drying operation using the dishwasher of FIG. 19.

Water drop detection may be performed in different manners in other embodiments. For example, FIG. 22 illustrates another process 466 for implementing a drying operation, which begins in block 468 by waiting a predetermined amount of time sufficient to introduce a temperature delta after initiating the drying operation. The predetermined amount of time may be determined empirically in some embodiments, and represents an amount of time, based upon the starting temperature of the utensils, where a temperature variance between water drops and at least some of the utensils in the load is sufficient to be detected in thermal images.

Block 470 then initiates a loop to periodically capture one or more thermal images of the wash tub, or at least a region of the wash tub, e.g., one or more racks of utensils, and block 472 analyzes the captured images to attempt to detect the presence of one or more water drops, e.g., in any of the various manners discussed above. Block 474 next determines whether a completion criterion for the drying operation has been met, e.g., based upon a detection of the absence of water drops, based upon a detection of a suitable decrease in quantity and/or size of water drops, based upon a predetermined period of time expiring after water drops are detected, or in other suitable manners that will be appreciated by those of ordinary skill having the benefit of the instant disclosure.

If the completion criterion is not met, control passes to block 476 to wait for a next capture interval. At the next interval, control returns to block 470 to repeat thermal image capture and analysis. Thus, blocks 470-476 iterate until the completion criterion has been met. In addition, it will be appreciated that during this time, one or more components in the dishwasher may be controlled based upon the detected water drops, e.g., to vary temperature and/or fan speed, to control one or more controllably-movable sprayers to spray air on various utensils in the load, etc. Then, once the criterion has been met, block 474 passes control to block 478, and the drying operation is complete.

In other embodiments, thermal imaging may be utilized in a dishwasher to control a drying operation without detecting water drops. Instead, thermal imaging may be used, for example, to detect the temperature of utensils and determine when the drying operation is complete, or to use the detected temperature to control how the drying operation progresses (e.g., by varying heat and/or fan speed, or by controlling sprayers to spray air on certain utensils based upon their temperatures).

Figure 23:
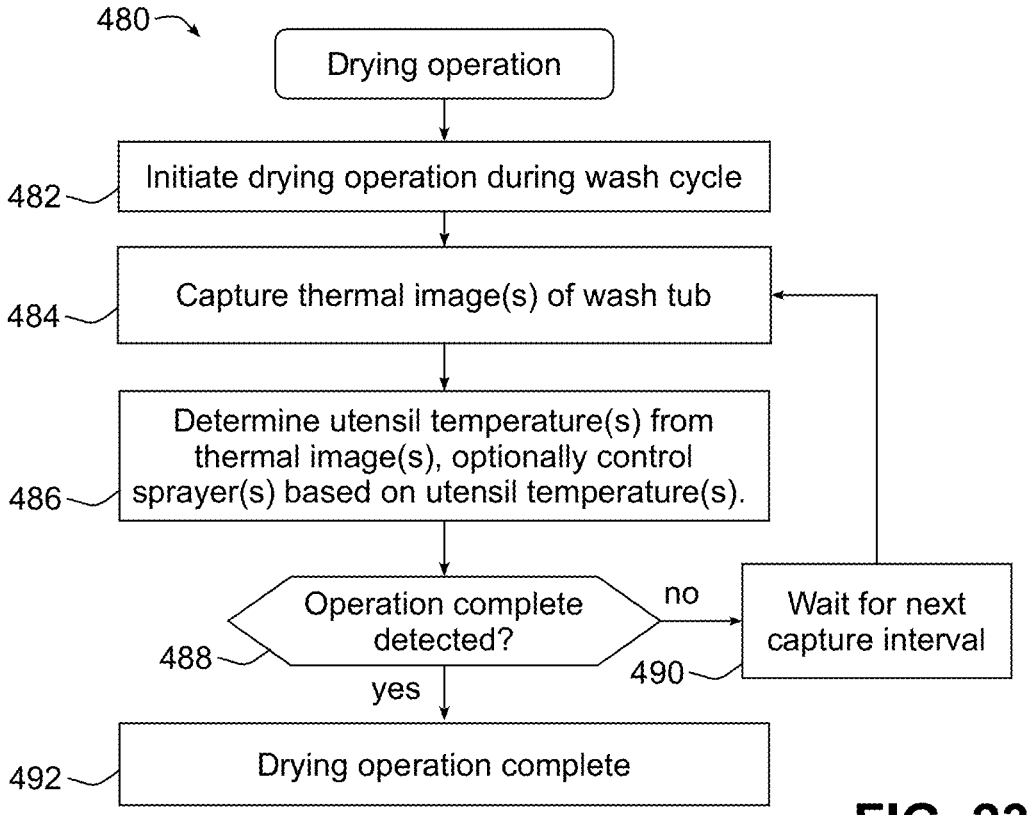
FIG. 23 is a flowchart illustrating yet another example sequence of operations for performing a drying operation using the dishwasher of FIG. 19.

For example, FIG. 23 illustrates another process 480 for implementing a drying operation, which begins in block 482 by initiating a drying operation during the wash cycle, e.g., at the conclusion of a final rinse. Block 484 then initiates a loop to periodically capture one or more thermal images of the wash tub, or at least a region of the wash tub, e.g., one or more racks of utensils, and block 486 analyzes the captured images to determine the temperatures of one or more utensils in the wash tub, e.g., based upon a correspondence between an infrared intensity sensed by the thermal imaging device and temperature. In addition, in some embodiments various optional operations may also be performed, e.g., to control one or more sprayers to spray air on various utensils based upon the detected temperatures. Block 488 next determines whether a completion criterion for the drying operation has been met, e.g., based upon a detection of the utensils reaching a predetermined temperature, based upon the expiration of a predetermined period of time after the utensils reaching a predetermined temperature, or in other suitable manners that will be appreciated by those of ordinary skill having the benefit of the instant disclosure. If the criterion is not met, control passes to block 490 to wait for a next capture interval, and upon reaching the next interval, control returns to block 484 to repeat thermal image capture and analysis. Thus, blocks 484-490 iterate until the completion criterion has been met. Then, once the criterion has been met, block 488 passes control to block 492, and the drying operation is complete.

Figure 24:
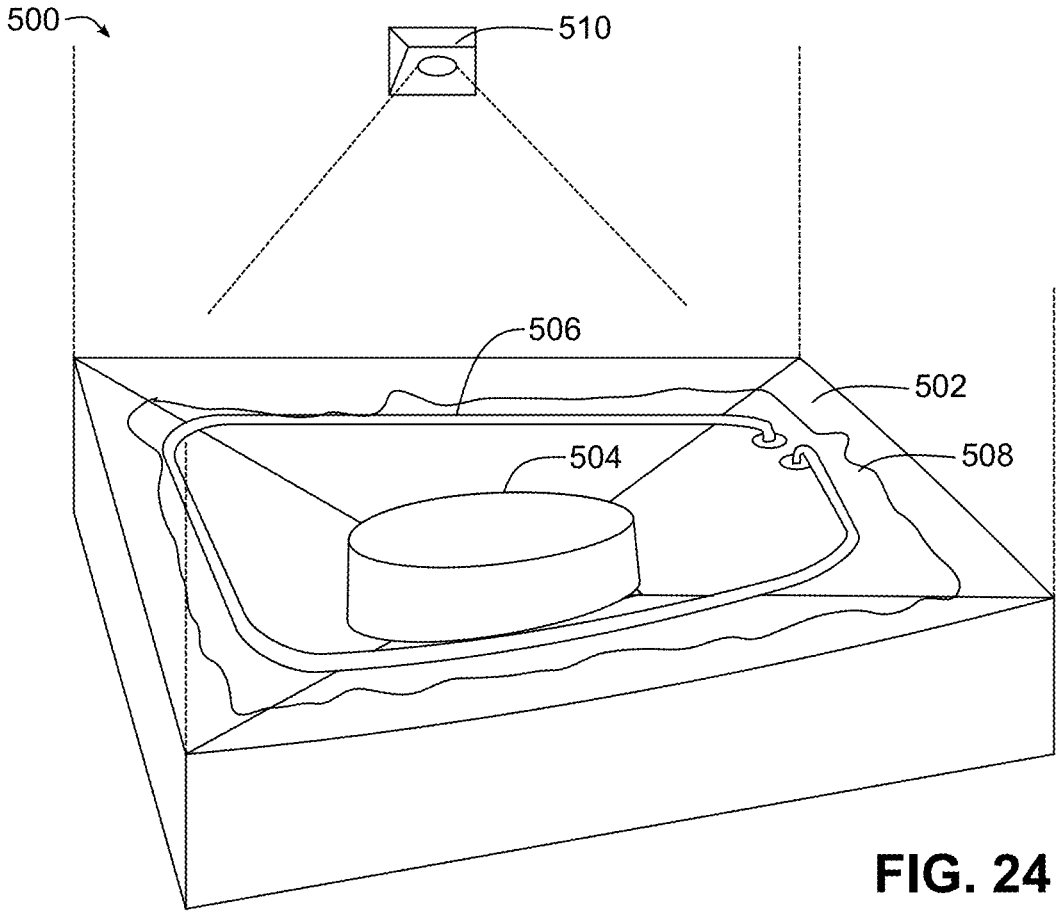
FIG. 24 is a perspective view of a sump region of a dishwasher including thermal sensing of wash fluid consistent with some embodiments of the invention.

In still other embodiments, thermal imaging may be used to regulate a temperature of a fluid in a dishwasher, e.g., fluid disposed within a sump of the dishwasher and heated by a heating element disposed therein, and used for wash and/or rinse operations. FIG. 24, for example, illustrates a portion of a dishwasher 500 including a sump 502, a filter 504, and a heating element 506, and shown with a volume of fluid 508 disposed therein. A thermal imaging device 510, e.g., a wall-mounted thermal camera, is also illustrated having a field of view including the sump, and being calibrated such that a sensed infrared intensity can be mapped to a corresponding fluid temperature.

Figure 25:
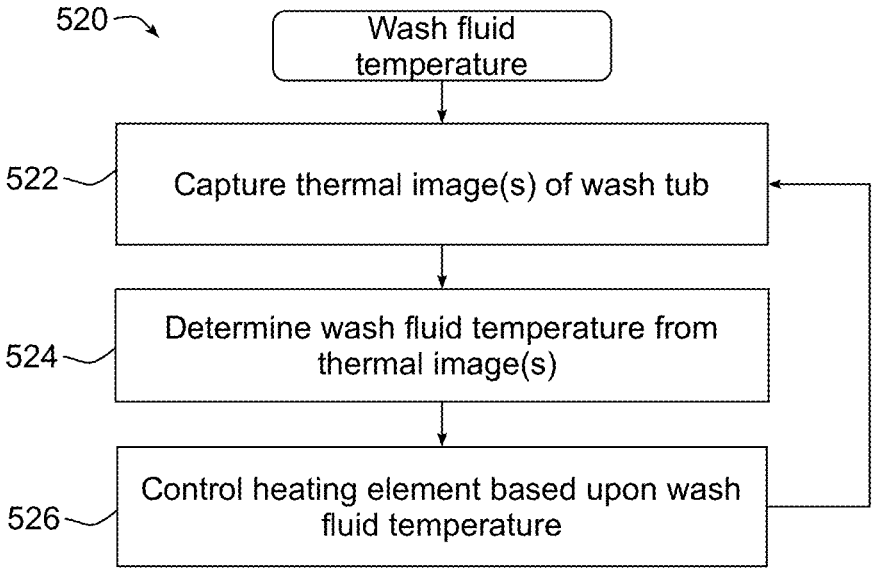
FIG. 25 is a flowchart illustrating an example sequence of operations for controlling the heating element of the dishwasher of FIG. 24.

FIG. 25 illustrates an example process 520 for regulating heating element 506 to maintain a desired temperature for fluid 508 in sump 502 of FIG. 25. Process 520 operates in a closed loop, and iterates between capturing thermal images of the wash tub (block 522), determining a wash fluid temperature from the captured thermal images (block 524) and controlling the heating element based upon the determined wash fluid temperature (block 526), e.g., by cycling the heating element on or off to maintain the desired fluid temperature.

In addition, in some embodiments, it may be desirable to utilize thermal imaging to monitor the states of various components of a dishwasher, e.g., a heating element, although the invention is not so limited as other components that generate perceptible heat signatures could also be monitored in a similar manner. As an example, the expected sheath temperature of a heating element can generally be determined based on wattage, surface area, and cycle state, so thermal imaging may be used in some embodiments to determine if the actual temperature various from an expected temperature, and take appropriate corrective actions as needed.

Figure 26:
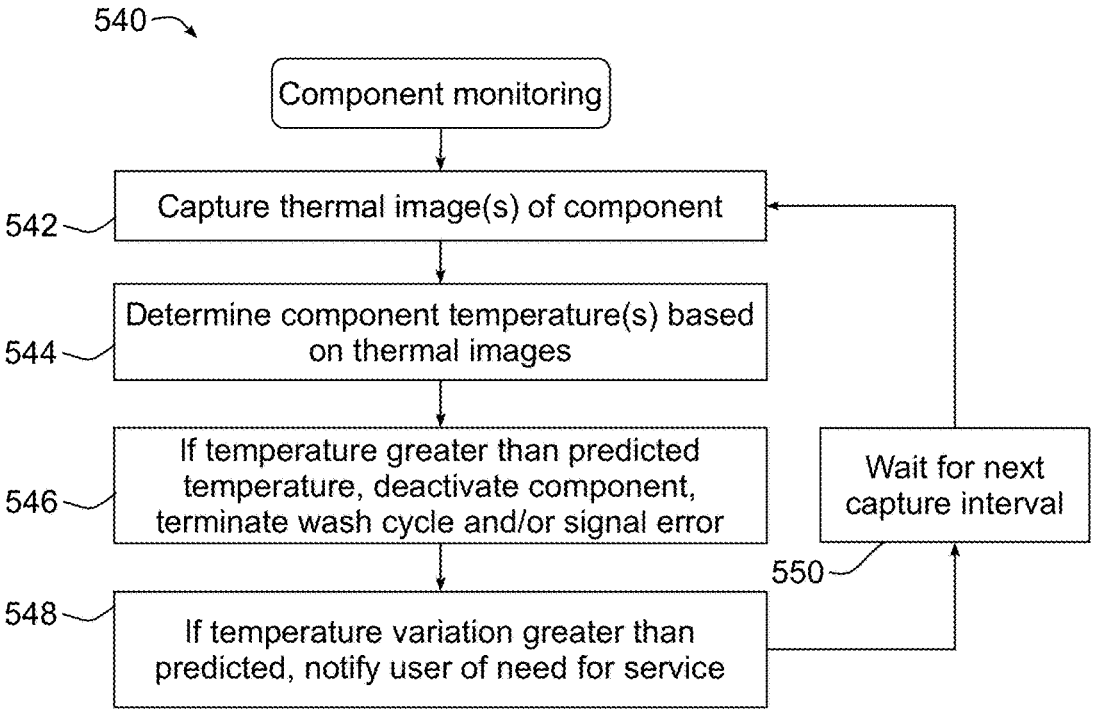
FIG. 26 is a flowchart illustrating an example sequence of operations for monitoring a component of the dishwasher of FIG. 24.

FIG. 26, for example, illustrates an example process 540 for monitoring a component such as a heating element in a dishwasher, e.g., during the performance of a wash cycle. In block 542, one or more thermal images of a component being monitored are captured, and in block 544, one or more temperatures are determined for the component from the captured image(s). Blocks 546 and 548 then test for two potential issues with the component based on the captured images. After testing for those issues, block 550 then waits for a next capture interval, and at the appropriate time, returns control to block 542 to start a new interval.

Block 546, for example, may determine if the temperature of any portion of the component exceeds a predicted value at a particular point in a wash cycle. If so, the component may be deactivated, the wash cycle may be terminated, an error signal may be generated, or some other corrective action may be taken. In some embodiments, such analysis may be used in conjunction with a thermal cutout as a multi-tiered safety net for a heating element.

Block 548, as another example, may analyze aging of a component. When a heating element, for example, begins to age, the actual coil within the sheath of the heating element may become cooler towards the endpoints and warmer towards the center. Thus, a user may be notified in some instances of a need for service, as the heating element may need to be replaced in the near future.

Other components and other temperature-related conditions may be monitored and analyzed in other embodiments. As such, the invention is not limited to the specific analysis performed in FIG. 26.

Figure 27:
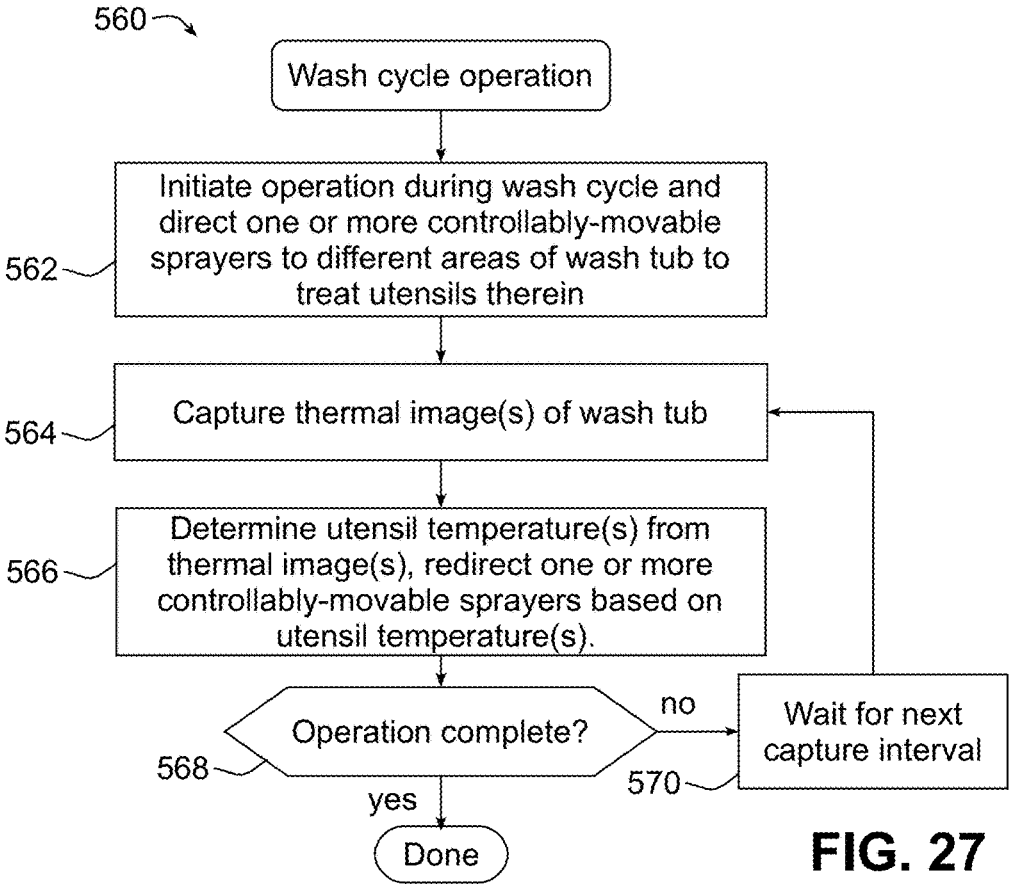
FIG. 27 is a flowchart illustrating an example sequence of operations for controlling controllably-movable sprayers using the dishwasher of FIG. 19.

FIG. 27 illustrates another application of thermal imaging suitable for use in some embodiments of the invention, specifically that of controlling one or more controllably-movable sprayers, e.g., tubular spray elements. FIG. 27, in particular, illustrates a process 560 for performing an operation during a wash cycle, e.g., a wash, rinse or drying operation. In this process, thermal imaging is used to sense temperature variations within a wash tub and then control one or more controllably-movable sprayers to direct those sprayers to particular regions of a wash tub based upon those temperature variations. For example, for wash and rinse operations, temperature variations may be used to identify areas of a dishwasher that are colder than others to identify areas not being washed or rinsed to the same degree as other areas (since spraying with hot wash fluid will generally increase the temperature of any utensils being sprayed), such that one or more controllably-movable sprayers may be targeted to spray additional fluid into those areas. As another example, for drying operations, temperature variations may be used to identify areas of a dishwasher that are hotter than others to identify areas that may need additional drying, such that one or more controllably-movable sprayers may be targeted to spray additional air into those areas.

For process 560, block 562 may initiate an operation (e.g., a wash, rinse, drying, etc. operation), and in connection with the operation, control one or more controllably-movable sprayers (e.g., tubular spray elements) to spray fluid (e.g., water, wash fluid or air) into different areas of a wash tub and thereby treat utensils in those areas. Various control methodologies may be used, e.g., to attempt to evenly treat different areas of a dishwasher. Block 564 may then capture one or more thermal images of the wash tub, and block 566 may determine utensil temperatures in different areas based upon the thermal images. Block 566 may also redirect one or more controllably-movable sprayers based at least in part upon the utensil temperature(s), e.g., to vary the control methodology used during the operation to additionally focus on one or more underserved areas of the wash tub. For a wash or rinse operation, for example, block 566 may direct one or more controllably-movable sprayers to spray wash fluid or water into colder areas of the wash tub, while for a drying operation, block 566 may direct one or more controllably-movable sprayers to spray air into hotter areas of the wash tub. It will be appreciated that block 566 may also perform additional image analysis in some embodiments, e.g., to identify sizes, quantities and/or types of utensils in different areas of the wash tub, which may also be considered in combination with temperatures when determining where to target various controllably-movable sprayers.

Next, block 568 determines whether the operation is complete, and if not, control passes to block 570 to wait for a next capture interval, after which control returns to block 564. Once the operation is complete, however, block 568 terminates process 560.

Thermal imaging may be used in other manners in a dishwasher consistent with the invention, and as will be appreciated by those of ordinary skill having the benefit of the instant disclosure. Therefore, the invention is not limited to the particular embodiments discussed herein.

CONCLUSION

It will be appreciated that the analysis of images captured by an imaging device, and the determination of various conditions reflected by the captured images, may be performed locally within a controller of a dishwasher in some embodiments. In other embodiments, however, image analysis and/or detection of conditions based thereon may be performed remotely in a remote device such as a cloud-based service, a mobile device, etc. In such instances, image data may be communicated by the controller of a dishwasher over a public or private network such as the Internet to a remote device for processing thereby, and the remote device may return a response to the dishwasher controller with result data, e.g., an identification of certain features detected in an image, an identification of a condition in the dishwasher, an value representative of a sensed condition in the dishwasher, a command to perform a particular action in the dishwasher, or other result data suitable for a particular scenario. Therefore, while the embodiments discussed above have predominantly focused on operations performed locally within a dishwasher, the invention is not so limited, and some or all of the functionality described herein may be performed externally from a dishwasher consistent with the invention.

Various additional modifications may be made to the illustrated embodiments consistent with the invention. Therefore, the invention lies in the claims hereinafter appended.

What is claimed is:

1. A dishwasher, comprising:

a wash tub;

a thermal imaging device configured to capture thermal images in the wash tub; and a controller coupled to the thermal imaging device and configured to control a wash cycle that washes a plurality of utensils disposed in the wash tub, the controller further configured to control the thermal imaging device to capture a thermal image of a utensil among the plurality of utensils and to configure the wash cycle based upon water drops disposed on the utensil and detected in the thermal image.

2. The dishwasher of claim 1, wherein the controller is configured to detect the water drops in the thermal image by performing image analysis on the thermal image to identify the water drops in the thermal image.

3. The dishwasher of claim 1, wherein the controller is configured to detect the water drops in the thermal image by communicating the thermal image to a remote device that identifies the water drops in the thermal image, and receiving a response associated therewith from the remote device.

4. The dishwasher of claim 1, wherein detection of the water drops in the thermal image is based upon a temperature variance between the water drops and a surface of the utensil upon which the water drops are disposed that is reflected in one or more regions of the thermal image corresponding to the water drops.

5. The dishwasher of claim 1, wherein the controller is configured to configure the wash cycle based upon the water drops by controlling a number and/or duration of a rinse operation, a wash operation, a soak operation or a drying operation.

6. The dishwasher of claim 1, wherein the controller is configured to configure the wash cycle based upon the water drops by controlling a fluid temperature, a fluid volume, a fan speed or a heating element temperature.

7. The dishwasher of claim 1, further comprising a controllably-movable sprayer in fluid communication with a fluid supply, and wherein the controller is coupled to the controllably-movable sprayer and is configured to configure the wash cycle based upon the water drops by controlling the controllably-movable sprayer to spray fluid onto a target based upon a detected location of one or more of the water drops.

8. The dishwasher of claim 7, wherein the fluid supply is an air supply, and wherein the controller is configured to control the controllably-movable sprayer to spray pressurized air onto the target.

9. The dishwasher of claim 1, wherein the controller is configured to configure the wash cycle based upon the water drops by controlling a duration of a condensation drying operation of the wash cycle performed subsequent to a hot water rinse of the plurality of utensils.

10. The dishwasher of claim 9, wherein the controller is configured to control the thermal imaging device to capture thermal images as the plurality of utensils cool during the condensation drying operation.

11. The dishwasher of claim 10, wherein the controller is configured to detect water drops on a utensil among the plurality of utensils after a temperature variance has been established between the water drops and a surface of the utensil.

12. The dishwasher of claim 11, wherein the controller is further configured to detect an absence of water drops on the utensil after detecting the water drops, and to control a duration of the condensation drying operation based upon the detection of the absence of water drops.

13. The dishwasher of claim 12, wherein the controller is further configured to store a thermal image depicting water drops as baseline thermal image, and to detect the absence of water drops by comparing the baseline thermal image with a thermal image captured subsequent to the baseline thermal image.

14. The dishwasher of claim 11, wherein the controller is further configured to detect a decrease in size and/or number of water drops on the utensil after detecting the water drops, and to control a duration of the condensation drying operation based thereon.

15. The dishwasher of claim 9, wherein the controller is configured to control the thermal imaging device to begin capturing thermal images as the plurality of utensils cool during the condensation drying operation only after a predetermined period of time sufficient to establish a temperature variance between the water drops and surfaces of the plurality of utensils has expired.

16. The dishwasher of claim 1, wherein the controller is configured to detect water drops on a utensil among the plurality of utensils further by performing image analysis to identify a surface of the utensil such that water drops disposed on surfaces of non-utensil objects depicted in the thermal image are ignored.

17. The dishwasher of claim 1, wherein the controller is configured to detect water drops on a utensil among the plurality of utensils further by performing image analysis on the thermal image and on one or more images captured by a visible spectrum imaging device disposed in the wash tub.

* * * * *